US008047630B2

(12) United States Patent
Kakuda

(10) Patent No.: US 8,047,630 B2
(45) Date of Patent: Nov. 1, 2011

(54) LIQUID DROP EJECTING HEAD AND IMAGE FORMING APPARATUS, LIQUID DROP EJECTING APPARATUS, RECORDING METHOD

(75) Inventor: Shinichi Kakuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 954 days.

(21) Appl. No.: 11/794,394

(22) PCT Filed: Nov. 10, 2006

(86) PCT No.: PCT/JP2006/322900

§ 371 (c)(1),
(2), (4) Date: Aug. 3, 2007

(87) PCT Pub. No.: WO2007/055408

PCT Pub. Date: May 18, 2007

(65) Prior Publication Data

US 2008/0111854 A1 May 15, 2008

(30) Foreign Application Priority Data

Nov. 11, 2005 (JP) ..... 2005-327318
Feb. 1, 2006 (JP) ..... 2006-025042

(51) Int. Cl.
*B41J 2/135* (2006.01)

(52) U.S. Cl. ..... 347/45; 347/47

(58) Field of Classification Search ..... 347/15, 347/20, 40, 43, 45–47, 67, 95–100, 105
See application file for complete search history.

(56) References Cited

U.S. PATENT DOCUMENTS

| | | | | |
|---|---|---|---|---|
| 5,502,470 | A * | 3/1996 | Miyashita et al. | 347/45 |
| 5,949,454 | A * | 9/1999 | Nozawa et al. | 347/45 |
| 6,050,676 | A * | 4/2000 | Sugimoto et al. | 347/43 |
| 6,109,728 | A | 8/2000 | Kakuda et al. | |
| 6,331,052 | B1 | 12/2001 | Murai et al. | |
| 7,314,267 | B2 * | 1/2008 | Yamaguchi et al. | 347/45 |
| 7,357,482 | B2 * | 4/2008 | Sugahara | 347/40 |
| 7,449,283 | B2 * | 11/2008 | Nishi et al. | 430/320 |

FOREIGN PATENT DOCUMENTS

| | | |
|---|---|---|
| JP | 2001-310476 | 11/2001 |
| JP | 2002-67288 | 3/2002 |
| JP | 2002-355957 | 12/2002 |
| JP | 3457458 | 8/2003 |
| JP | 2003-268277 | 9/2003 |
| JP | 2004-358877 | 12/2004 |
| JP | 2005-238531 | 9/2005 |
| JP | 2005-307177 | 11/2005 |

OTHER PUBLICATIONS

Oct. 6, 2008 official action in connection with a counterpart Korean patent application No. 10-2007-7015839.

* cited by examiner

*Primary Examiner* — Thinh Nguyen
(74) *Attorney, Agent, or Firm* — Cooper & Dunham LLP

(57) ABSTRACT

The same water-repellent process is provided on a nozzle forming part and the outer circumferential part of a nozzle formation member. A first water-repellent layer is formed through a first water-repellent process on the surface of a nozzle forming part (which forms nozzles on a surface of a nozzle plate, and a second water-repellent layer is formed through a second water-repellent process different from the first water-repellent process on the surface of the outer circumferential part (outer portion of surface) of the nozzle plate.

21 Claims, 12 Drawing Sheets

LIQUID DROP EJECTING HEAD AND IMAGE FORMING APPARATUS, LIQUID DROP EJECTING APPARATUS, RECORDING METHOD

TECHNICAL FIELD

This disclosure relates to a liquid drop ejecting head and an image forming apparatus. Especially, the invention relates to the liquid drop ejecting head in which a water-repellent processing is provided on the surface and the image forming apparatus having the liquid drop ejecting head, a liquid drop ejecting apparatus, a recording method.

BACKGROUND ART

As an image forming apparatus such as a printer, a facsimile, a copying machine, and a composite machine thereof, for example, an ink jet recording apparatus is known. The ink jet recording apparatus with the liquid drop ejecting head as a recording head performs recording (image formation, character printing, image printing, and printing may be used as synonyms) by ejecting ink as recording liquid onto a medium to be recorded (hereinafter it is called paper form which is not limited to a paper as a material but it may be also called a recording medium, a transfer paper, a transfer material and recorded material).

However, since the liquid drop ejecting head performs recording by ejecting the liquid drop from a nozzle, a nozzle forming and precision have big influence on a jet characteristic of an ink drop. Also, it is known that surface properties of a nozzle formation member forming a nozzle hole affect the jet characteristic of an ink drop. When ink adheres to a circumference part of nozzle hole of the nozzle formation member surface and uneven ink gathering occurs, for example, it is known that inconvenience occurs such that an ejection course of an ink drop is changed, and variation occurs to size of an ink drop, and flight speed of an ink drop becomes unstable.

For the conventional liquid drop ejecting head, it is known that not only water-repellent processing to repel the ink (ink-repellent processing) on the surface of nozzle formation member forming a nozzle is given but also a collection of the wiped ink after cleaning of the nozzle surface is accumulated and there is a problem that the paper surface is touched the collection of the wiped ink and pollute the paper surface, a water-repellent processing is provided on the opposite surface facing a surface and the side of a nozzle cover, also the water-repellent processing is provided on a head base to fix the head when the nozzle cover which covers outer parts of the nozzle formation member is provided.

Patent Document 1: JP 3457458

Patent Document 2: JP 2001-310476,A

Patent Document 3: JP 2002-067288,A

BRIEF SUMMARY

In an aspect of this disclosure, there is provided a liquid drop ejecting head in which the water-repellent processing is provided on surfaces of the nozzle formation member and the nozzle cover and on the head base as described above, the water-repellent process to form a water-repellent layer having same water-repellent characteristics by same process based on a purpose to communize the processing is provided.

However, the water-repellent process on the surface of the nozzle formation member formed the nozzle needs careful maintenance such as prevention of approach of the water-repellent layer to the inside of the nozzle, equalization of the film thickness of the water-repellent layer and so on. On the other hand, the water-repellent process on the nozzle cover forming the outer circumferential part of the nozzle formation member needs only rough maintenance of presence of the water-repellency.

Thus, communization as the water-repellent process against the surface of the nozzle formation member requiring high maintenance for these different requirement formations is to perform the water-repellent process against the surface of the nozzle formation member having lots of limitation to the outer circumferential part. There is a problem that this leads to high cost of the processing.

Especially, when other member like nozzle cover is used for the outer circumferential part of the nozzle formation member, it is preferable to perform the water-repellent process on the nozzle cover only. Thus, there is more advantage to select simple process or cheap process due to the water-repellent process with only the nozzle cover than advantage due to the commonization of the processing.

Also, since the nozzle formation part forming the nozzle of the nozzle formation member and the outer circumferential part have the same water-repellent process, every faces have almost same water-repellent and the remaining wiped ink is left on the nozzle surface and the outer circumferential part at random. There is a problem that when this accumulates, after all, paper surface dirt is caused.

In an aspect of this disclosure, there is provided a liquid drop ejecting head in which cost can be decreased by simple processing the water-repellent processing on the outer circumferential part of the nozzle formation member required less formation and the image forming apparatus having the liquid drop ejecting head, liquid drop ejecting apparatus, recording method.

In another aspect, there is provided a liquid drop ejecting head that has a structure, in which the water-repellent process repelling the recording liquid is provided on a surface of a nozzle formation member forming the nozzle, and the water-repellent process of an outer circumferential part of the nozzle formation member is different from the water-repellent process on a surface of a nozzle forming part of the nozzle formation member. The outer circumferential part of the nozzle formation member means including the outer circumferential part of the nozzle formation member, a covering member if it is provided on the outer circumferential part of the nozzle formation member.

Here, it is preferable that the water-repellency on the outer circumferential part of the nozzle formation member is relatively higher than a water-repellency of the nozzle forming part. Also, edge region of the outer circumferential part of the nozzle formation member is covered with a protection member formed with a resin member having the water-repellency.

Also, the outer circumferential part of the nozzle formation member is covered with a nozzle cover, and the water-repellent process is provided on the nozzle cover. In this case, it is preferable that the water-repellent process is provided on both side of an outer side and an inner side of the nozzle cover.

The water-repellent process including silicone resin is provided on the nozzle forming part of the nozzle formation member. The water-repellent process including fluorine amorphous substance compound is provided on the outer circumferential part of the nozzle formation member. The head is a side shooter mechanism which is difference between an ejection direction of the liquid drop and a direction of a flow channel of the recording liquid.

In another aspect of this disclosure, there is provided an image forming apparatus that includes the aforementioned recording head ejecting liquid droplets of recording liquid.

Here, recording liquid is an ink including pigments.

In another aspect, there is provided a liquid drop ejection apparatus that includes the aforementioned liquid drop ejection head.

In another aspect, there is provided a recording method wherein one or more liquid droplets are ejected from the aforementioned liquid drop ejection head and a recording is performed on the recording medium.

Here, the recording medium is composed of a base material and at least one coating layer on a surface of the base material. The amount of the recording liquid transferred onto the recording medium at a contact time of 100 ms measured by a dynamic scanning absorptometer with an environmental condition of 23 degree Celsius and 50% RH is between 2 and 40 $ml/m^2$, and the amount of the recording liquid transferred onto the recording medium at a contact time of 400 ms measured by a dynamic scanning absorptometer with an environmental condition of 23 degree Celsius and 50% RH is between 3 and 50 $ml/m^2$. Otherwise, the amount of a pure water transferred onto the recording medium at a contact time of 100 ms measured by a dynamic scanning absorptometer with an environmental condition of 23 degree Celsius and 50% RH was between 2 and 45 $ml/m^2$, and the amount of the pure water transferred onto the recording medium at a contact time of 400 ms measured by a dynamic scanning absorptometer with an environmental condition of 23 degree Celsius and 50% RH is between 3 and 50 $ml/m^2$.

The recording medium is composed of at least the base material and the coating layer, and a solid content of the coating layer is between 0.5 and 20 $g/m^2$. The grammage of the recording medium is between 50 and 250 $g/m^2$. The recording medium is supercalendered. The recording medium contains kaolin as a pigment. The recording medium contains heavy calcium carbonate as a pigment. The recording medium contains a water-based resin. The water-based resin is a water-soluble resin or a water-dispersible resin.

Also, the recording liquid contains at least water, a colorant, and a humectant. The surface tension of the recording liquid at a temperature of 25 degree Celsius is between 15 and 40 mN/m. The recording liquid contains a dispersible colorant and an average particle diameter of the dispersible colorant is between 0.01 and 0.16 μm. The viscosity of the recording liquid at a temperature of 25 degree Celsius is between 1 and 30 mPa·sec. The recording liquid contains a fluorinated surfactant.

According to the aforementioned liquid drop ejecting head, cost can be decreased by simple processing of the water-repellent processing on the outer circumferential part of the nozzle formation member required less formation because different water-repellent processes are provided on the outer circumferential part of the nozzle formation member and the nozzle formation part formed the nozzle.

According to the aforementioned image forming apparatus and liquid drop ejecting apparatus, the cost can be decreased because they utilize the aforementioned liquid drop ejecting head.

According to the aforementioned recording method, a high quality image can be recorded because liquid drop is ejected from the aforementioned liquid drop ejecting head.

Other aspects, features and advantages will become more apparent from the following detailed description.

BEST MODE FOR CARRYING OUT THE INVENTION

Figure 1:
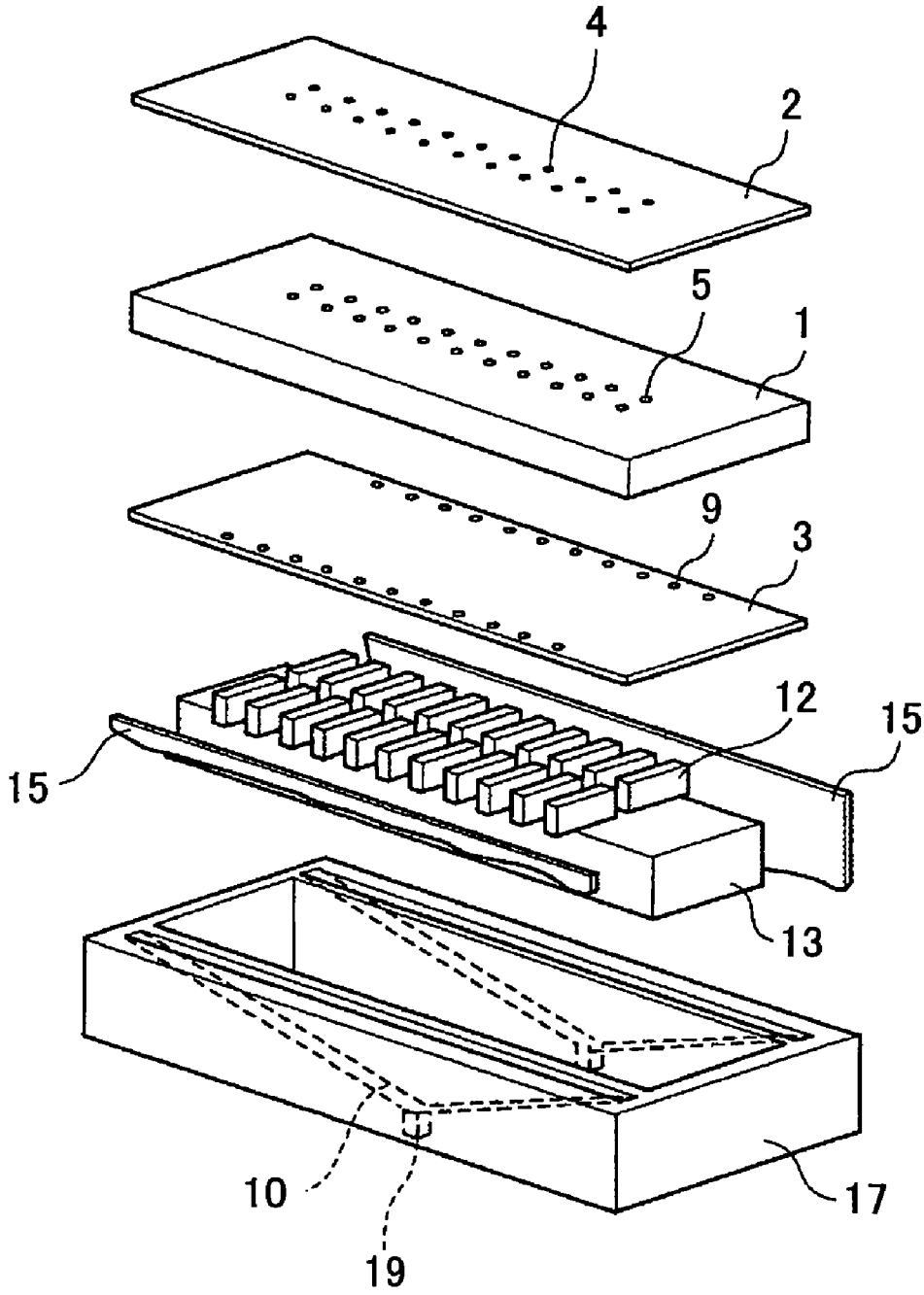
FIG. 1 is an exploded perspective view showing the first embodiment of the liquid drop ejecting head of the present invention.
Figure 2:
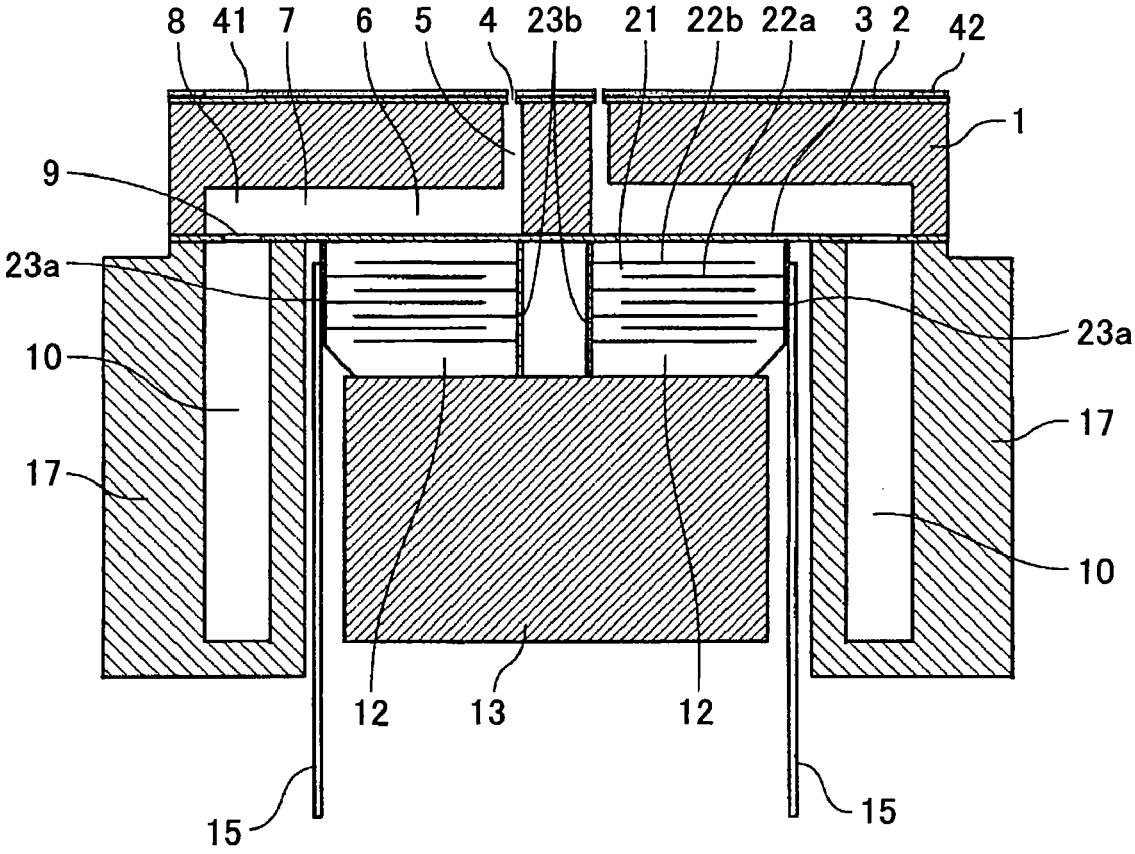
FIG. 2 is a sectional view along the long direction of the liquid chamber of the head.
Figure 3:
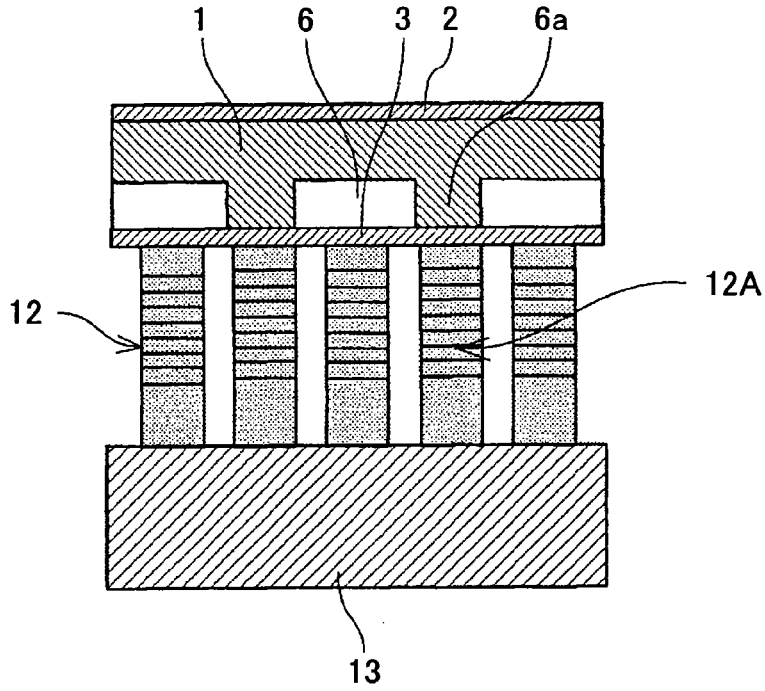
FIG. 3 is a sectional view of bi-pitch structure along the short direction of the liquid chamber of the head.

In the below, a description is given, with reference to the accompanying drawings, of an embodiment of the present invention. The first embodiment of the liquid drop ejecting head of the present invention will be described with reference to FIGS. 1-3. Also, FIG. 1 is an exploded perspective view of the liquid drop ejecting head of the present invention; FIG. 2 is a sectional view along the long direction of the liquid chamber of the head; and FIG. 3 is a sectional view along the short direction of the liquid chamber of the head.

For example, this liquid drop ejecting head has a channel plate 1 which was made from a single crystal silicon board, a nozzle plate 2 which is the nozzle formation member jointed on an upper surface of the channel plate 1 and a vibratory plate 3 which is the nozzle formation member jointed on an lower surface of the channel plate 1. Thereby, the liquid drop ejecting nozzle 4 forms a pressure application liquid chamber 6 communication though a communication channel 5, a fluid resistance part 7 and a communication part 8 communicating with the liquid chamber 6 via the fluid resistance part 7. Then, recording liquid (for example, ink) can be supplied from common liquid chamber 10 formed on a frame member 17 which is described below via supply part 9 formed the vibratory plate 3 of the communication part 8.

Then, the upper end surface of a laminating type piezoelectric transducer 12 as a drive element (actuator means, pressure force occurring means) via connection part not showing formed on the vibratory plate 3 is jointed on the outer side of the vibratory plate 3 forming wall of the liquid chamber 6 (on the opposite side of the liquid chamber 6) corresponding to each pressure application liquid chamber 6. Also, the lower edge surface of the laminating type piezoelectric transducer 12 is jointed on the base member 13.

Here, the piezoelectric transducer 12 is which laminated a piezoelectric material layer 21 and inner electrodes 22*a*, 22*b* alternately, then inner electrodes 22*a*, 22*b* are drawn to edge surfaces respectively and connected to edge surfaces electrodes (outer electrodes) 23*a*, 23*b*. Thereby, a displacement of a laminating direction is produced by applying voltage to edge surfaces electrodes 23*a*, 23*b*.

Then, in order to provide a drive signal, FPC cable 15 is connected to the piezoelectric transducer 12 via solder joining or ACF (different directional conductive film) joining or wire bonding. A drive circuit (driver IC) not shown here for applying drive wave selectively to each piezoelectric transducer 12 is mounted on the FPC cable 15

Figure 4:
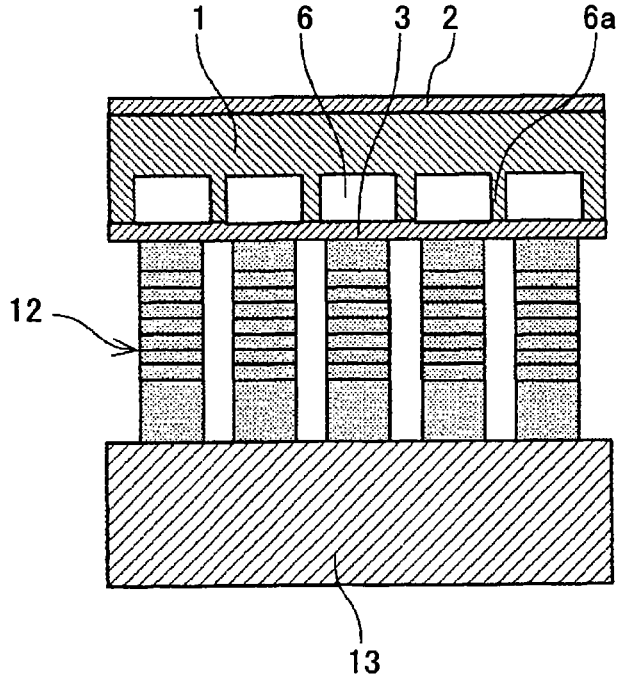
FIG. 4 is a sectional view of normal-pitch structure along the short direction of the liquid chamber of the head.

Also, as shown in FIG. 3 for the short direction (direction of nozzles 4 line) of the liquid chamber, the bi-pitch structure in which the piezoelectric transducer 12 and a prop part 12A are placed alternately can be provided or the normal pitch structure not having the prop part 12 can be provided as shown in FIG. 4.

In this head, using the displacement of d33 direction as the piezoelectric direction of the piezoelectric transducer 12, a structure in which ink in the liquid chamber 6 is pressurized, also a structure of the ejection direction of liquid drop is a structure in which ejecting liquid drop using side shooter means different with flow direction of recording liquid in the liquid chamber 6. By using the side shooter, the size of the piezoelectric transducer 12 becomes the size of the head, miniaturization of the piezoelectric transducer 12 leads to the miniaturization of the head directly, thereby the miniaturization of the head can be easy to be planned.

In addition, frame member 17 formed by injection molding with epoxy resin or polyphenylene sulfate is jointed on the outer circumferential part of the actuator part structured with the above piezoelectric transducer 12, base member 13 and FPC 15. Then, the above common liquid chamber 10 is formed on this frame member 17, and the supply 19 which supplies recording liquid from outside is formed on the common liquid chamber 10, then the supply 19 is also connected to the source of recording liquid such as sub-chamber or recording liquid cartridge which are not shown.

Here, for example, the channel plate 1 forms ditches comprising the communication channel 5, through-hole becoming the pressure application liquid chamber 6, the fluid resistance part 7 and the communication part 8 respectively by different directional etching the single crystal silicon board of a crystal face direction (110) using alkaline etching solution such as potassium hydroxide solution (KOH).

The nozzle plate 2 is formed from a metallic plate of Nickel (Ni) and manufactured with electroforming method (electrocasting). Nozzles 4 which has 10-35 micrometers diameter corresponding to each pressure chamber 6 is formed on the nozzle plate 2 and the nozzle plate 2 is adhesively jointed to the channel plate 1. Then, two kind of water-repellent layers forming with different water-repellent process as described below are provided on the liquid drop ejection side (surface of the ejection direction: ejection surface or the opposite surface against the liquid ink 6) of the nozzle plate 2.

The vibratory plate 3 is formed from a metallic plate of Nickel (Ni) and manufactured with electroforming method (electrocasting). In the vibratory plate 3, a part corresponding to the pressure liquid chamber 6 is thin part to be easy deforming and a connection part (not shown) for jointing with the piezoelectric transducer 12 is provided in central part.

The piezoelectric transducer 12 is formed by providing and dividing the ditching process with dicing-saw and so on after jointing the laminating type piezoelectric transducer with the base member 13. The prop part 12A having bi-pitch structure described in FIG. 3 is the piezoelectric transducer member formed by ditch processing, but it functions as only a prop because the drive voltage is not applied.

In the liquid drop ejecting head constructed as the above, for example, the vibratory plate 3 is deform to the direction of the nozzle plate 2 as displacing the applied piezoelectric transducer 12 with pulse voltage by applying 2-50 voltage of driving pulse voltage selectively to multiple piezoelectric transducer 12 corresponding to image to be recorded from a control part (not shown) when the head is drove with a pushing and beating method, and liquid drop is ejected from nozzles 4 of the nozzle plate 2 by pressuring liquid in the liquid chamber 6 due to volume change in the liquid chamber 6. Then, the pressure in the liquid chamber 6 is decreasing correspond to the ejecting of liquid drop, and by means of inertia of a liquid flow of this time, some underpressure occurs in the liquid chamber 6. Under these circumstances, even more particularly, underpressure occurs so that the vibratory plate 3 returns to an original position, and the liquid chamber 6 becomes original shape by means of making application of the voltage to a piezoelectric transducer 12 an off state. In this time, the recording liquid is filled in the liquid chamber 6 from the common liquid chamber 10, then liquid drop is ejected from the nozzle 4 as correspond to next driving pulse.

Moreover, the liquid drop ejecting head can be driven by not only the pushing and beating method but also a pulling and beating method (a method that the vibratory plate 3 is opened at the state that is pulled, and to pressurize in power of restitution) and pulling and pushing method (a method that the vibratory plate 3 is held at an intermediate position, then pushing after pulling from this position) and so on.

Figure 5:
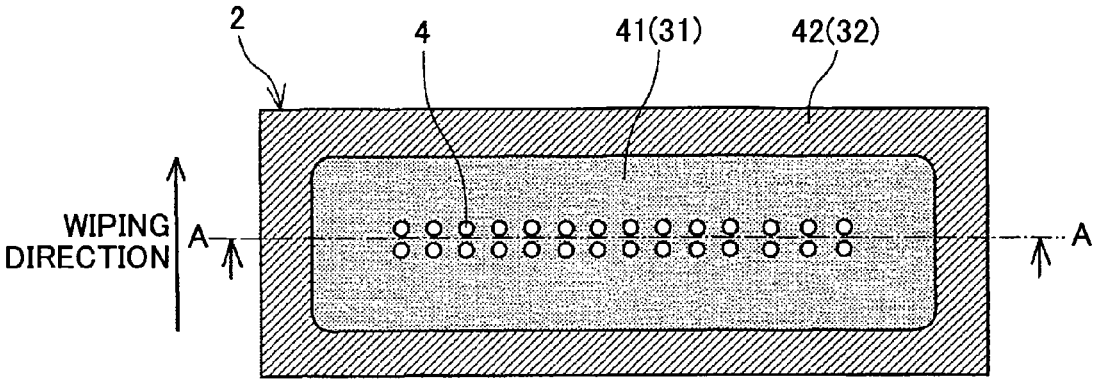
FIG. 5 is a plan view showing the nozzle plate of the head.
Figure 6:
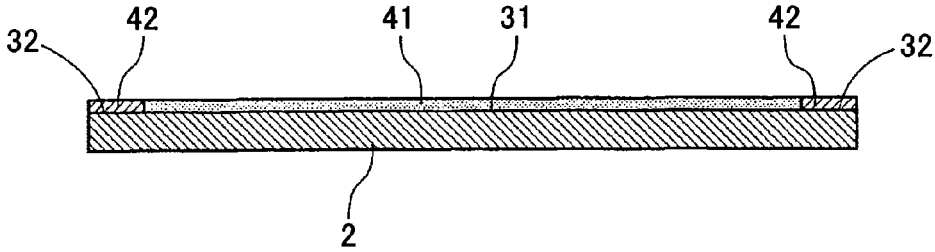
FIG. 6 is a sectional view along A-A line of the FIG. 5.

Next, the nozzle plate 2 as the nozzle formation member for the liquid drop ejecting head is explained reference with FIGS. 5 and 6. FIG. 5 is the plan view of the nozzle plate 2, and FIG. 6 is the sectional view along A-A line of FIG. 5.

The first water-repellent layer 41 due to the first water-repellent process is formed on the surface of the nozzle forming part 31 formed the nozzle 4 of the surface of the nozzle plate 2, and the second water-repellent layer 42 due to the second water-repellent process different from the first water-repellent process is formed on the surface of the outer circumferential part (outer portion of surface) of the nozzle plate 2. The nozzle forming part means regions including nozzles in the nozzle plate, and it is used as a term to indicate regions except outer edge (outer circumferential part) of the surface of the nozzle plate. Also, different materials are used for the first water-repellent process and the second water-repellent process respectively.

The outer circumferential part (outer portion of surface) 32 of the nozzle plate 2 is a terminal position of wiping of a cleaning wiper when the surface of the nozzle plate 2 is cleaning (wiping) with the cleaning wiper. It is easy to accumulate wiped ink and its remaining at that place. Since the accumulated ink is a cause that it pollutes paper, the water-repellent process is provided on the outer circumferential part of the nozzle formation member as countermeasure.

Figure 7:
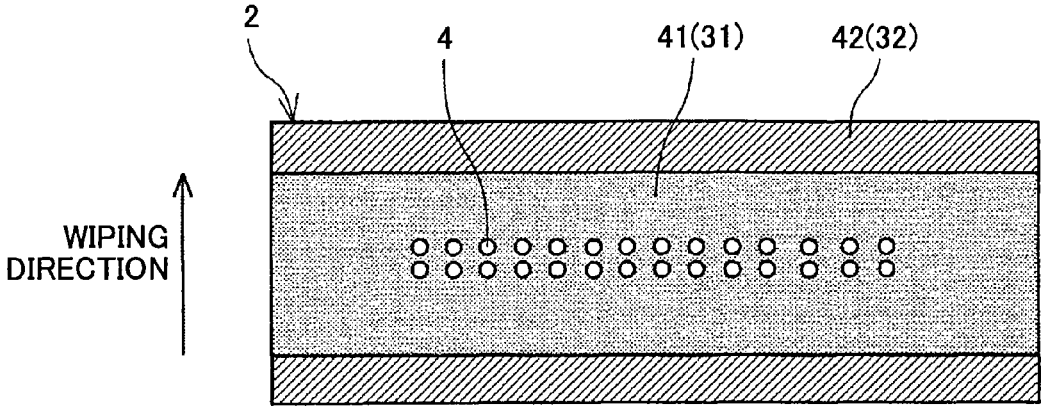
FIG. 7 is a plan view showing the nozzle plate of other embodiment of the head.

Thus, the second water-repellent layer 42 is formed on all area of the outer circumferential part 32 of the nozzle plate 2 in this embodiment, but the second water-repellent layer 42 may be formed only on portions where is started to wipe and terminated to wipe of the wiping direction of the outer circumferential part of the nozzle plate 2 as shown in FIG. 7.

Thus, the water-repellent process which repels the recording liquid is provided on the surface of the nozzle formation member formed the nozzle and different water-repellent processes are provided on the outer circumferential part of the nozzle formation member and the nozzle forming part. Thereby, the water-repellent process about the outer circumferential part requiring less needs of structure can be simple process and low cost of a head can be planned.

Figure 8:
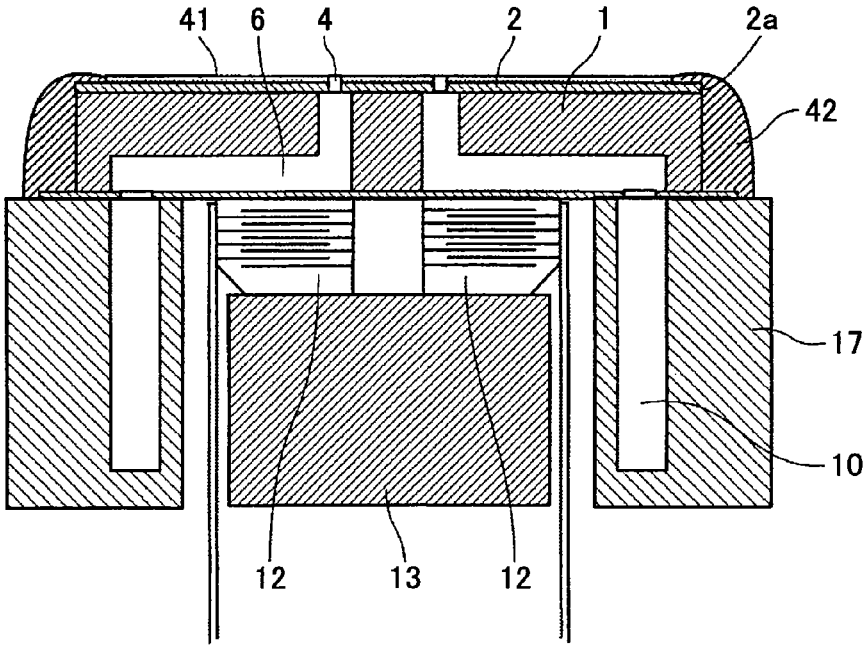
FIG. 8 is a sectional view showing the second embodiment of the liquid drop ejecting head of the present invention.

Next, the second embodiment of the liquid drop ejecting head of the present invention is explained reference with FIG. 8. FIG. 8 is a sectional view showing the second embodiment of the liquid drop ejecting head.

Here, the second water-repellent layer 42 comprising resin material having water-repellency as a protection means to protect edge parts 2*a* of the nozzle plate 2 as the second water-repellent process is coated on the outer circumferential part 32 of the nozzle plate 2. Also, the first water-repellent layer 41 with the first water-repellent process is formed on the surface of the nozzle forming part 31 of the nozzle plate 2 as well as the first embodiment.

The protection method of such an edge parts of nozzle formation member is a general method, there is an advantage to prevent the nozzle formation member from peeling off caused by contacting edges of paper. In this case, generally, the water-repellent process of the surface of the nozzle formation member has a restriction for materials and processing so as to prevent the water-repellent agent from getting into the inner wall of the nozzle. However, there would be a free choice regardless of materials, viscosity and process method about the outer circumferential part by providing different process compared to the water-repellent process for the surface of the nozzle forming part of the nozzle formation member.

For example, since the water-repellent process of the surface of the nozzle forming part of the nozzle formation member needs to form with thin layer, generally, materials having low viscosity are used. Because of this, conventionally, it is needed that the surface of the nozzle forming part is coating with the water-repellent agent having low viscosity after coating the protection agent of resin on the outer circumferential part of the nozzle formation member. On the other hand, since the water-repellent process is different provided on the outer circumferential part and the nozzle forming part, it is possible to coat resin materials having high viscosity with the water-repellency directly on the outer circumferential part as the above embodiment. Shortening of the process can be planned with a large scale.

Figure 9:
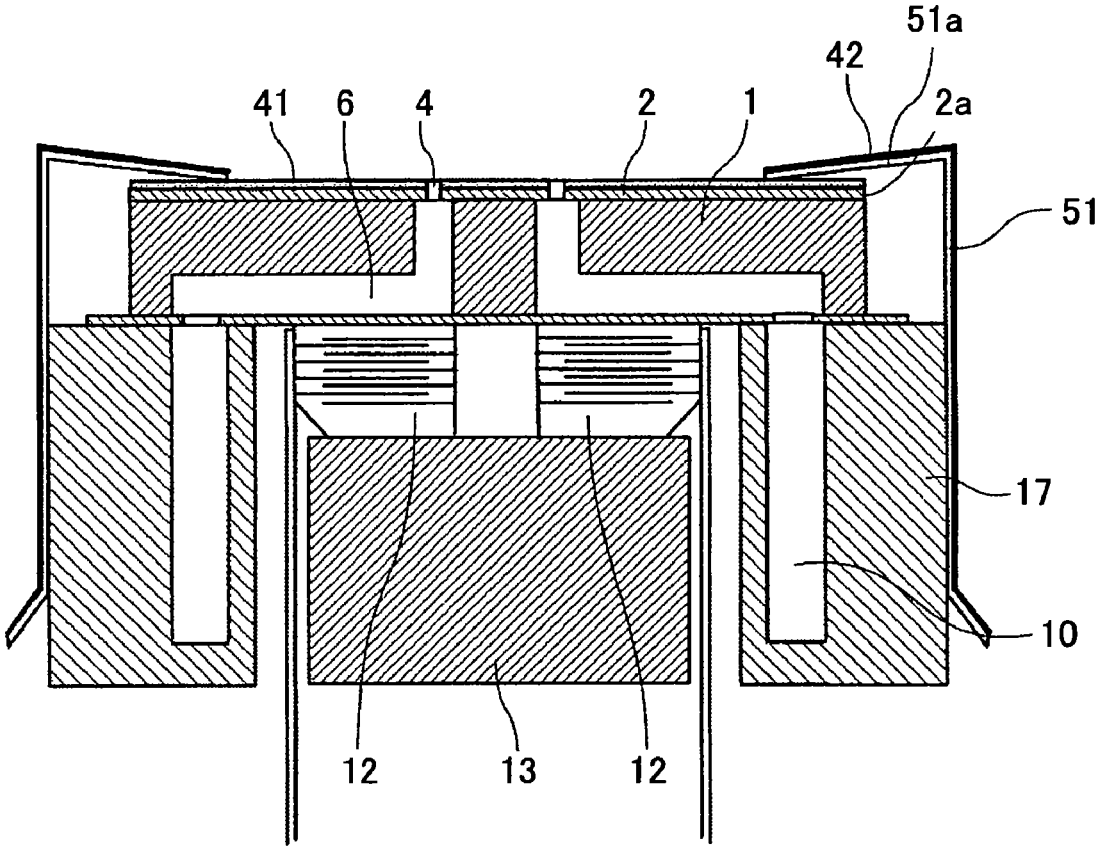
FIG. 9 is a sectional view showing the third embodiment of the liquid drop ejecting head of the present invention.

Next, the third embodiment of the liquid drop ejecting head of the present invention is explained reference with FIG. 9. FIG. 9 is a sectional view showing the third embodiment of the liquid drop ejecting head.

Here, the nozzle cover 51 protecting the outer circumferential part 32 of the nozzle plate 2 and head side is put on the head, and the second water-repellent layer 42 due to the second repellent process is formed on the surface part 51*a* which is opposite direction of at least paper face of the nozzle cover 51. By doing this, the second water-repellent layer 42 which is different from the first water-repellent layer 41 of the surface of the nozzle forming part 31 is formed on the outer circumferential part of the nozzle plate 2. In this case, in order to simplify the surface treatment of the nozzle plate 2, the first water-repellent layer 41 is formed on the all surfaces including outer edges covered by the nozzle cover 51 of the nozzle plate 2.

As described above, the water-repellent process of the surface of the nozzle forming part of the nozzle forming member has a restriction such as protection of the inner wall of nozzle and complicated coating process. However, the water-repellent process of the nozzle cover does not have such a restriction. For example, it is possible to coat the water-repellent agent on the nozzle cover with just dipping and drying completely by only selecting quick-drying materials. Shortening of the process can be planned with a large scale. The second water-repellent layer 42 is indicated only on the side of the nozzle caver 51 in FIG. 51, the second water-repellent layer 42 is formed on all surfaces of outer and inner surfaces when the second water-repellent layer 42 is formed on the nozzle cover 5 by dipping.

As clear from these embodiments, by doing that different water-repellent process are provided on the nozzle forming part of the nozzle formation member and the outer circumferential part, free selection of materials and processing method is increased, and the head having high quality and low cost can be obtained.

Figure 10:
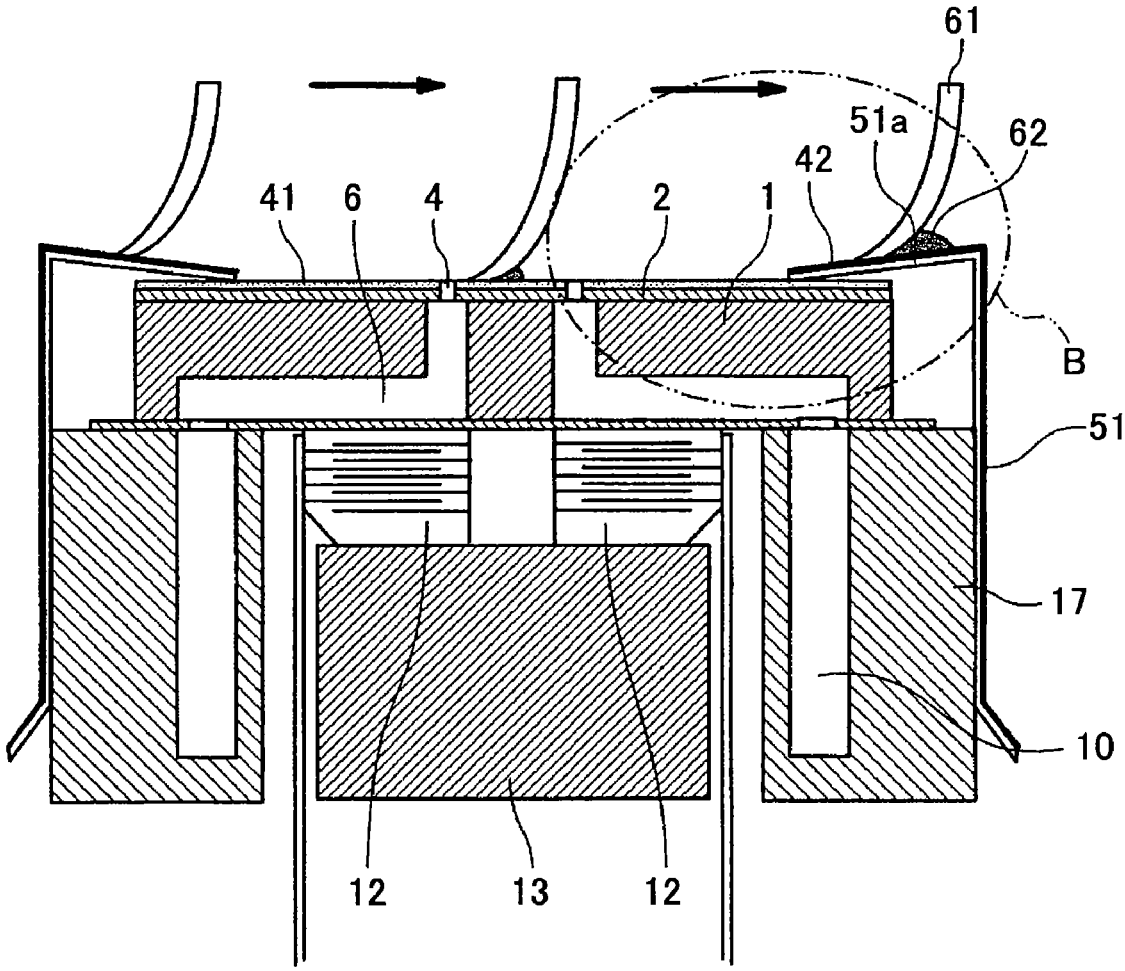
FIG. 10 is a diagram showing a relationship of water-repellency between the first water-repellent layer and the second water-repellent layer.
Figure 11:
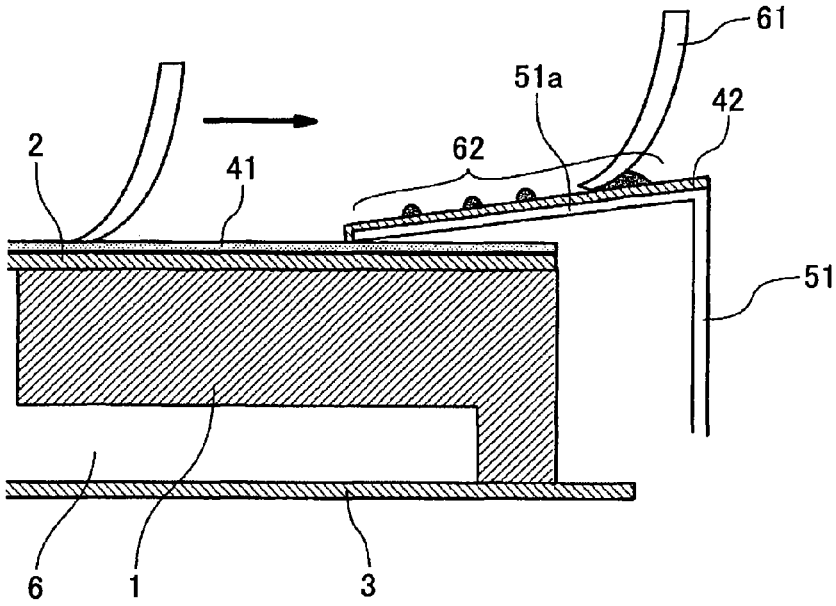
FIG. 11 is an enlarged view of the B part of the FIG. 10 when the water-repellency of the first water-repellent layer is greater than the water-repellency of the second water-repellent layer.
Figure 12:
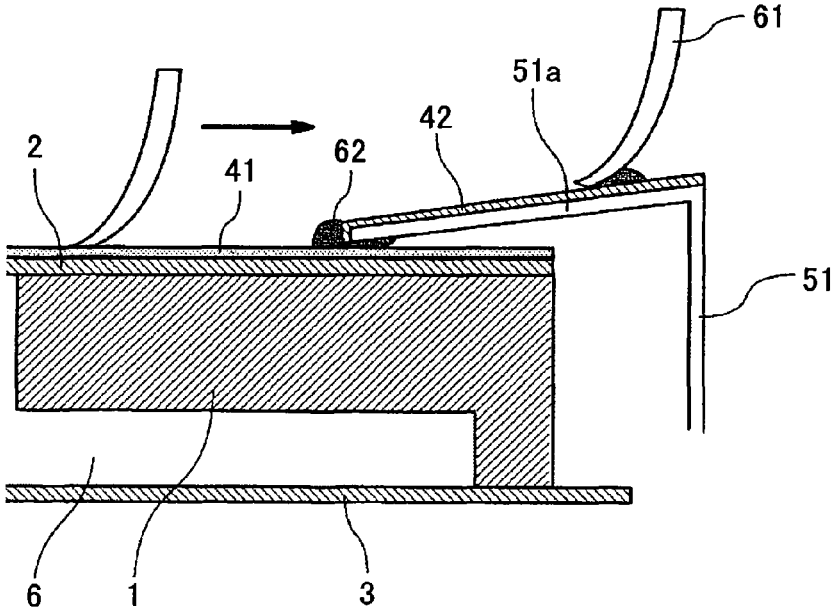
FIG. 12 is an enlarged view of the B part of the FIG. 10 when the water-repellency of the second water-repellent layer is greater than the water-repellency of the first water-repellent layer.

Next, the water-repellency of the first water-repellent layer and the second water-repellent layer is explained using the third embodiment reference with FIGS. 10-12. FIG. 10 is a diagram to wipe the nozzle surface. FIGS. 11 and 12 are enlarged view of the B part of the FIG. 10.

It is preferable that the water-repellency of the second water-repellent layer 42 of the outer circumferential part (here, the nozzle cover 51) of the nozzle plate 2 is higher than the water-repellency of the first water-repellent layer 41 of the nozzle forming part 31 of the nozzle plate 2 comparing the first water-repellent layer 41 and the second water-repellent layer 42.

That is, there is a possibility that the wiped and remaining ink (the remaining ink 62) is occurred partially on the outer circumferential part of the head as shown in FIGS. 10 and 11 when the nozzle surface is wiped (cleaned) by the wiper 61 in the case that the water-repellency of the surface (the first water-repellent layer 41) of the nozzle forming part 31 is higher than the water-repellency of the second water-repellent layer 42 of the outer circumferential part of the nozzle plate 2. The accumulated ink in this position due to the wiped and remaining ink leads friction with paper side, as a result, a fall of printing quality is caused.

On the other hand, when the water-repellency of the outer circumferential part of the nozzle plate 2 is higher than the water-repellency of the nozzle forming part 31, ink is remaining at a boundary region of the water-repellent process and it reduces to pollute the outer circumferential part of the nozzle plate 2. In general, as explained in embodiment 2 and 3, there are many cases that the outer circumferential part of the nozzle plate 2 is higher than the surface of the nozzle plate 2 itself, remaining ink not on the outer circumferential part but at the edge of the surface of the nozzle forming part 31 does not lead friction with paper side and the remaining ink, and a fall of printing quality can be prevented.

Figure 13:
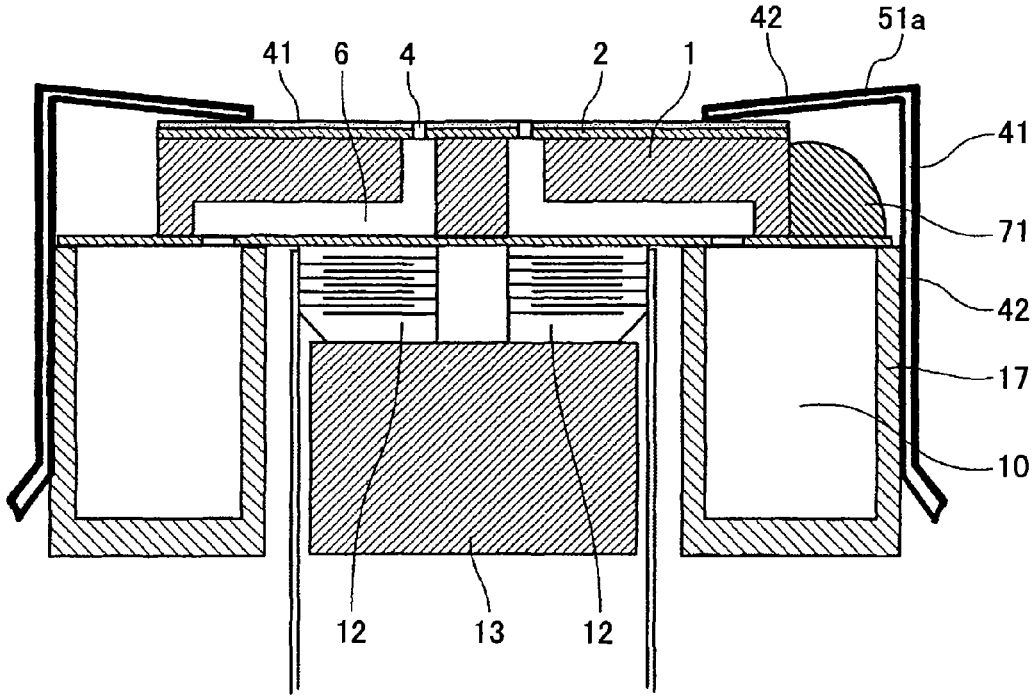
FIG. 13 is a sectional view showing the third embodiment of the liquid drop ejecting head of the present invention.
Figure 14:
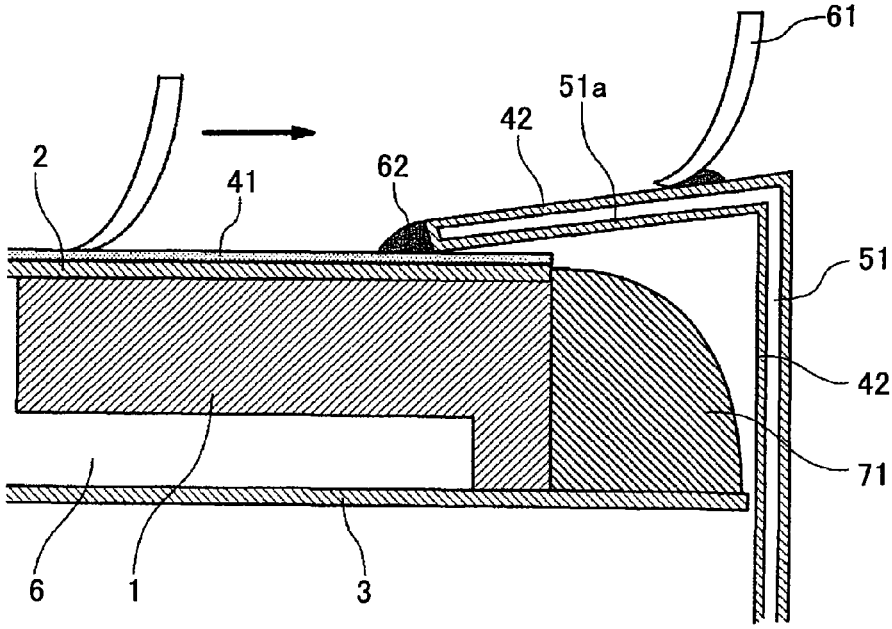
FIG. 14 is an enlarged view of the C part of the FIG. 13.

Next, the fourth embodiment of the liquid drop ejecting head of the present invention is explained reference with FIGS. 13 and 14. FIG. 13 is a sectional view of the head. FIG. 14 is an enlarged view of the C part of the FIG. 13.

Here, the second water-repellent layer 42 is formed all surfaces of outer and inner surfaces by forming the second water-repellent layer 42 on the nozzle cover 51 with dipping as described above. The remaining ink is remained on the nozzle forming part and the nozzle cover 51 boundary region by providing the water-repellent process on the inner side (the opposite side) of the nozzle cover 51 and the wiped ink by the head cleaning is not going into the inside of the nozzle cover 51 as shown in FIG. 14. Because of this, since ink does not penetrate even though the process that has no ink resistance on the inside of the nozzle cover 51 is performed, a reliability of the head is not lost. That is, in the embodiment of FIG. 12 showing only the formation of the second water-repellent layer 42 on the outer side of the nozzle cover 51, as shown in the figure, there is a possibility to penetrate ink into the inside of the nozzle cover 51, but that ink invades the inside of the nozzle cover 51 can be prevented surely in this embodiment.

Concretely, material to control vibration 71 (this material is eluted to ink because the materials are low molecular resin) can be applied to the vibratory plate 2 on the common liquid chamber 10 to suppress liquid vibration in the common liquid chamber 10.

Next, embodiment about the water-repellent process (ink-repellent process) used in the above embodiments is explained. There are various type such as Ni-PTFE Deposition plating, coating of Fluorinated resin, silicone resin, an evaporation membrane for the water-repellent process. However, it is preferable to use the process with silicone family or the process with fluorine family, especially with fluorine amorphous substance compound in order to secure ink-repellency as against ink having high viscosity, and more against ink including fluorine family with high luminescence.

Concretely, silicone family resin material includes Silicone Resin KR series (product name), SR series (product name) of Torey dowcoaning silicone, and so on. Fluorine amorphous substance compound includes Optule (product name) of Daikin, Sitop (product name) of Asahi glass, and so on.

The ink-repellent process using the above silicone family resin material can be applied to any of the surface of the nozzle forming part of the nozzle plate, the outer circumferential part of the nozzle formation member. In general, since the ink-repellency of fluorine amorphous substance compound is preferable for ink having high viscosity including fluorine family surfactant, it is preferable that silicone family resin is used for the surface of the nozzle forming part of the nozzle formation member and fluorine amorphous substance compound is used for the surface of the nozzle formation member when the both processes are used.

Figure 15:
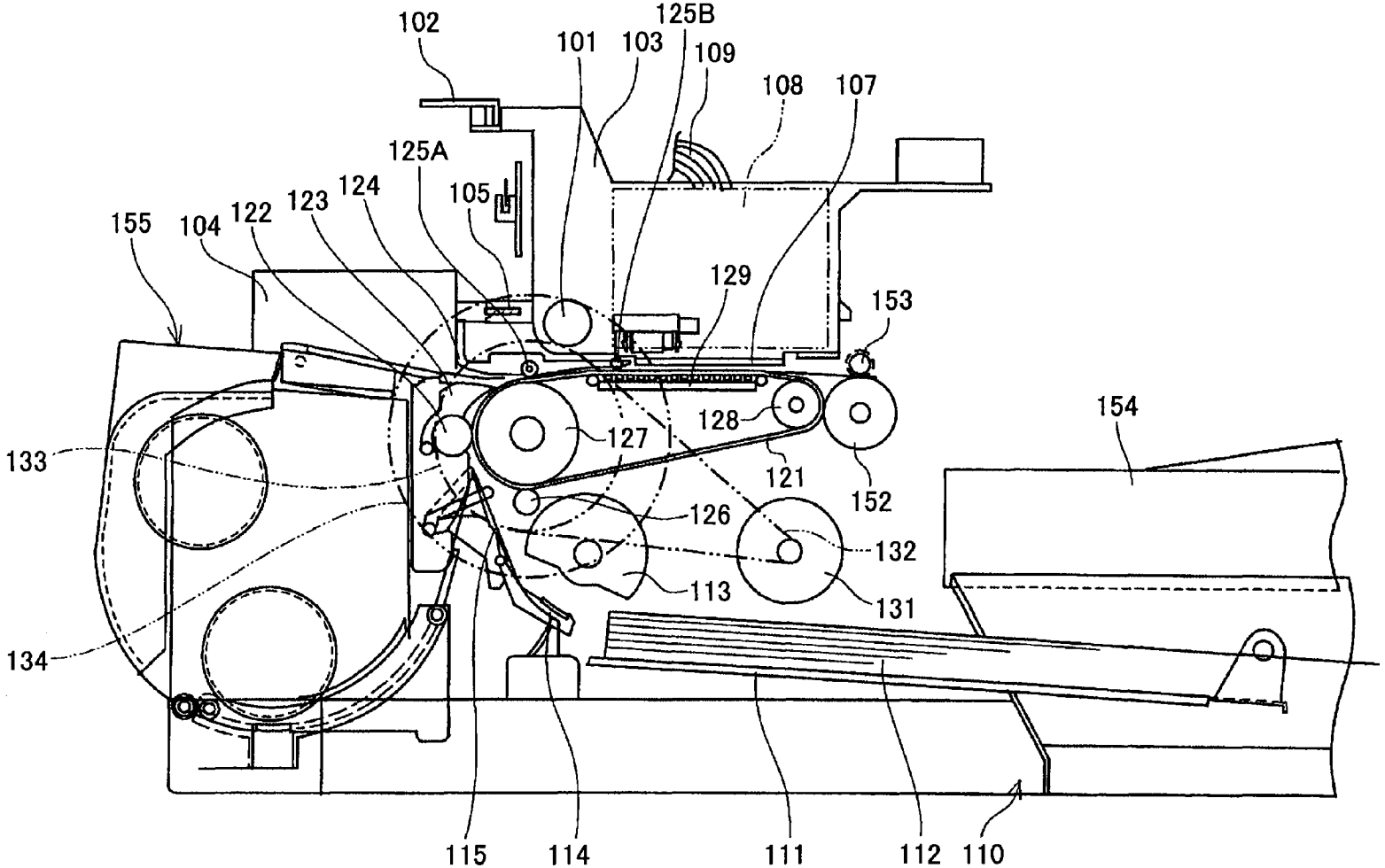
FIG. 15 is a total structural view showing an embodiment of the image forming apparatus of the present invention.
Figure 16:
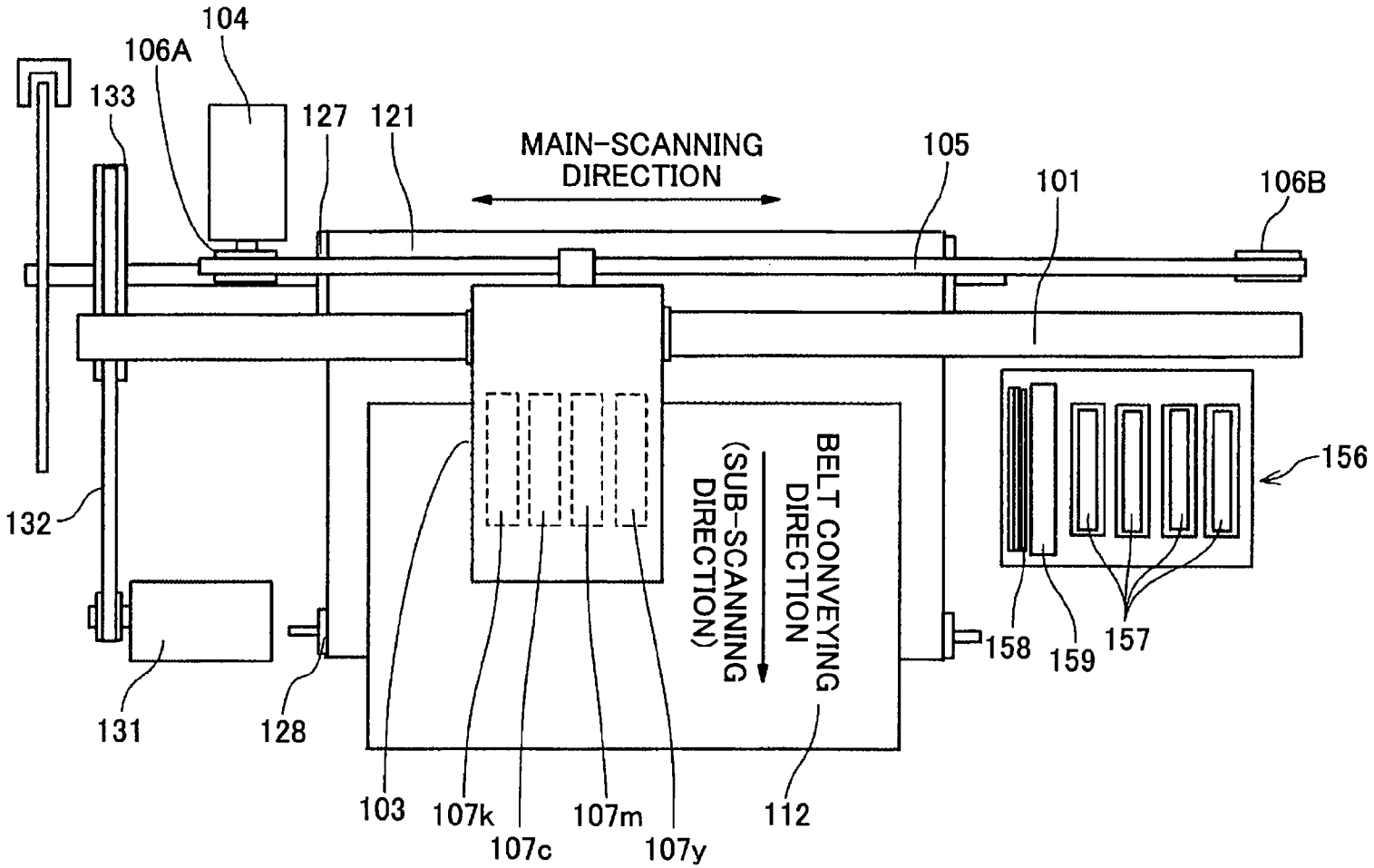
FIG. 16 is a plan view showing essential parts of the image forming apparatus of the present invention.

Next, an embodiment of the image forming apparatus including the liquid drop ejecting apparatus provided with the liquid drop ejecting head of the present invention is explained reference with FIGS. 15 and 16. FIG. 15 is a side view of a total structure of the image forming apparatus. FIG. 16 is a plan view showing essential parts of the image forming apparatus.

The image forming apparatus has a guiding rod 101 and a guiding rail 102 which are guiding members provided on the right and left side plates (not shown) and sliding freely and holding a carriage 103 in main scanning direction, and in which operation, the carriage is moved and scanned in a direction of the arrow (the main scanning direction) via a timing belt 105 over between a driving pulley 106A and a passive pulley 106B by main scanning motor 104.

A recording head 107 comprising four independent liquid drop ejecting heads 107*k*, 107*c*, 107*m* and 107*y* of the present invention ejecting liquid drop (ink drop) of each color (for example, black (K), cyan (C), magenta (M) and yellow (Y)) of recording liquid is placed in a direction along the main scanning direction and provided such that the liquid drop ejecting direction is directed in downward on the carriage 103. Here, independent liquid drop ejecting head is used, but one or plural heads having plural nozzle rows for ejecting respective color ink liquid can be also used. Additionally, the number and arrangement order of colors and are not limited to them.

A subchamber of each respective color 108 which supply each respective color ink to the recording head 107 is equipped on the carriage 103. Ink is filled and supplied from the main chamber (ink cartridge) (not shown) via an ink supply tube 109 to the subchamber 108.

The exemplary image forming apparatus also includes a paper feeding unit for feeding medium to be recorded (paper sheets) 112 stacked on a paper stacking plate (pressing plate) 111 of a paper feed tray 110. The paper feeding unit includes a crescent roller (paper feed roller) 113 for separating the paper sheets 112 and feeding them one by one from the paper stacking plate 111, and a separating pad 114 facing the paper feed roller 113 and made of a material with a high friction coefficient. The separating pad 114 is biased toward the paper feed roller 113.

The exemplary image forming apparatus also includes a conveying unit for conveying the paper sheet 112 fed from the paper feeding unit to a position under the recording heads 107. The conveying unit includes a guide 115 that guides the paper sheet 112 fed from the paper feeding unit, a conveyor belt 121 that electrostatically attracts and thereby conveys the paper sheet 112, a counter roller 122 that presses the paper sheet 112 against the conveyor belt 121 and thereby conveys the paper sheet 112, a conveying guide 123 that changes approximately 90 degrees the direction of the paper sheet 112 being fed approximately vertically upward so that the paper sheet 112 is laid on the conveyor belt 121, a pressing part 124, and a pressing roller 125A and a tip pressing roller 125B biased by the pressing part 124 toward the conveyor belt 121. The exemplary image forming apparatus also includes a charging roller 126 for charging the surface of the conveyor belt 121.

The conveyor belt 121 is an endless belt and is stretched between a conveying roller 127 and a tension roller 128. The conveyor belt 121 is turned in the paper conveying direction (sub scanning direction) by the conveying roller 127 rotated by a sub scanning motor 131 via a timing belt 132 and a timing roller 133. A guide 29 is provided under the conveyor belt 121 in a position corresponding to the image forming area of the recording heads 107.

The charging roller 126 is positioned so as to contact the surface of the conveyor belt 121 and to rotate according to the rotation of the conveyor belt 121, and also the charging roller 126 presses 2.5N each as pressing pressure on the both ends of an axis.

The exemplary image forming apparatus further includes a paper ejecting unit for ejecting the paper sheet 112 on which an image has been recorded by the recording heads 107. The paper ejecting unit includes a sheet separating part for separating the paper sheet 112 from the conveyor belt 121, a paper ejecting roller 152, a paper ejecting roller 153, and a paper catch tray 154 for receiving the ejected paper sheet 112.

A duplex unit 155 is detachably attached to the back of the exemplary image forming apparatus. The duplex unit 155 takes in the paper sheet 112 that is conveyed backward by the conveyor belt 121 turning in the opposite direction, reverses the paper sheet 112, and feeds the paper sheet 112 again into the space between the counter roller 122 and the conveyor belt 121.

Also, as shown in FIG. 14, a recording head maintenance/cleaning mechanism 156 is provided in a non-image-forming area to the right of the carriage 103. The recording head maintenance/cleaning mechanism 156 maintains and cleans the nozzles of the recording heads 107.

The recording head maintenance/cleaning mechanism 156 includes caps 157 for covering the nozzle surfaces of the recording heads 107, a wiper blade 158 for wiping the nozzle surfaces, and a waste-ink receiver 159 for receiving ink drops used for purging dried ink from the nozzles.

Next, ink as recording liquid used in the recording method of the present invention in which record in the recording medium (paper sheet) by ejecting liquid drop from the liquid drop ejecting head of the present invention is explained.

Ink used in the recording method of the present invention comprises at least water, a coloring agent and a wetting agent, also ink comprises a penetrant, a surfactant and other ingredients as necessary.

The surface tension of an ink according to an embodiment of the present invention at 25 degree Celsius is preferably between 15 and 40 mN/m, and more preferably between 20 and 35 mN/m. When the surface tension of an ink is less than 15 mN/m, the wettability of the nozzle plate to the ink becomes too high. As a result, ink drops may not be formed normally, bleeding may occur on a recording medium of this embodiment, and ink spray stability may be reduced. When the surface tension of an ink is more than 40 mN/m, the penetration capability of the ink is reduced, beading may occur, and the drying time may become longer.

The surface tension of an ink is measured, for example, by a surface tensiometer (for example, CBVP-Z of Kyowa Interface Science Co., Ltd.) with a platinum plate at a temperature of 25 degree Celsius.

In addition, color materials of ink can use pigments or dye, even more particularly, color materials can be used as mixed them.

[Pigments]

As pigments, nominated below is preferably used. Also, these pigments can be used by mixing plural kinds of thereof.

For example, the following organic pigments may be used: azo series, phthalocyanine series, anthraquinone series, quinacridone series, dioxazine series, indigo series, thioindigo series, perylene series, isoindolinon series, aniline black, azomethine series, rhodamine B lake pigment, and carbon black.

Also, the following inorganic pigments may be used: iron oxide, titanium oxide, calcium carbonate, barium sulfate, aluminum hydroxide, barium yellow, iron blue, cadmium red, chrome yellow, and metallic flake.

The diameter of pigment particles is preferably between 0.01 and 0.30 μm. When the diameter is smaller than 0.01 μm, the size of pigment particles is close to that of dye particles. Such a pigment provides low light resistance and causes feathering. When the diameter of pigment particles is larger than 0.30 μm, the pigment particles may clog ink jet nozzles or filters in a printer and reduces spray stability. From the point of view of clog and spray stability, the diameter of pigment particles is preferably between 0.01 and 0.16 μm.

Preferably, a carbon black pigment for a black pigmented ink is made by a furnace method and a channel method, and has a primary diameter of 15-40 millimicron, a BET specific surface area of 50-300 $m^2/g$, a DBP oil absorption of 40-150 ml/100 g, a volatile matter content of 0.5-10%, and a pH value of 2-9. For example, the following carbon black pigments may be used: No. 2300, No. 900, MCF-88, No. 33, No. 40, No. 45, No. 52, MA7, MA8, MA100, No. 2200B (Mitsubishi Chemical Corporation); Raven 700, Raven 5750, Raven 5250, Raven 5000, Raven 3500, Raven 1255 (Columbian Chemicals Company); Regal 400R, Regal 330R, Regal 660R, MogulL, Monarch 700, Monarch 800, Monarch 880, Monarch 900, Monarch 1000, Monarch 1100, Monarch 1300, Monarch 1400 (Cabot Corporation); Color black FW1, Color black FW2, Color black FW2V, Color black FW18, Color black FW200, Color black S150, Color black S160, Color black S170, Printex 35, Printex U, Printex V, Printex 140U, Printex 140V, Special black 6, Special black 5, Special black 4A, and Special black 4 (Degussa).

Examples of pigments are listed below.

The following organic pigments may be used: azo series, phthalocyanine series, anthraquinone series, quinacridone series, dioxazine series, indigo series, thioindigo series, perylene series, isoindolinon series, aniline black, azomethine series, rhodamine B lake pigment, and carbon black. Also, the following inorganic pigments may be used: iron oxide, titanium oxide, calcium carbonate, barium sulfate, aluminum hydroxide, barium yellow, iron blue, cadmium red, chrome yellow, and metallic flake.

Examples of pigments for each color are listed below.

The following pigments may be used for yellow ink: CI pigment yellow 1, 2, 3, 12, 13, 14, 16, 17, 73, 74, 75, 83, 93, 95, 97, 98, 114, 128, 129, 151, and 154.

The following pigments may be used for magenta ink: CI pigment red 5, 7, 12, 48 (Ca), 48 (Mn), 57 (Ca), 57:1, 112, 123, 168, 184, and 202.

The following pigments may be used for cyan ink: CI pigment blue 1, 2, 3, 15:3, 15:34, 16, and 22; and CI vat blue 4 and 60.

A pigment newly manufactured for the present invention may also be used for each color ink.

An ink jet recording liquid may be produced by dispersing one of the above pigments in an aqueous medium using a polymeric dispersing agent or a surfactant. As a dispersing agent for dispersing organic pigment powder, a water-soluble resin or a water-soluble surfactant may be used.

As a water-soluble resin, a block copolymer, a random copolymer, or salt made of two or more monomers selected from a group including styrene, styrene derivative, aliphatic alcohol ester of α, β-ethylene unsaturated carboxylic acid, acrylic acid, acrylic acid derivative, maleic acid, maleic acid derivative, itaconic acid, itaconic acid derivative, fumarate, and fumarate derivative may be used. The above water-soluble resins are alkali-soluble resins that are soluble in water solution of a base.

A water-soluble resin with a weight-average molecular weight of 3000-20000 is easily dispersible, is able to provide a dispersion liquid with a low viscosity, and is therefore especially preferable for an ink jet recording liquid.

Also, a combination of a polymeric dispersing agent and a self-dispersing pigment is preferable to obtain an appropriate dot diameter. A possible reason why such a combination provides a preferable result is described below.

Mixing a polymeric dispersing agent in an ink suppresses the penetration capability of the ink. Also, mixing a polymeric dispersing agent prevents aggregation of a self-dispersing pigment and helps the self-dispersing pigment to spread smoothly in the horizontal direction. As a result, an ink dot spreads thin and wide. An ink with such characteristics makes it possible to form a desirable dot.

As a water-soluble surfactant, the following substances may be used: anionic surfactants such as higher fatty acid salt, alkyl sulfate, alkyl ether sulfate, alkyl ester sulfate, alkyl arylether sulfate, alkyl sulfonate, sulfosuccinate, alkyl allyl and alkyl naphthalene sulfonate, alkyl phosphate, polyoxyethylene alkyl ether phosphate ester salt, alkyl allyl ether phosphate; cationic surfactants such as alkyl amine salt, dialkyl amine salt, tetraalkyl ammonium salt, benzalkonium salt, alkyl pyridinium salt, imidazolinium salt.

Also, as a amphoteric surfactant, the following substances may be used: amphoteric surfactants such as dimethyl alkyl lauryl betaine, alkyl glycine, alkyldi(aminoethyl)glycine, imidazolinium betaine; and nonionic surfactants such as polyoxyethylene alkyl ether, polyoxyethylene alkyl allyl ether, polyoxyethylene polyoxypropylene glycol, glycerin ester, sorbitan ester, sucrose esters, polyoxyethylene ether of glycerin ester, polyoxyethylene ether of sorbitan ester, polyoxyethylene ether of sorbitol ester, fatty acid alkanolamide, polyoxyethylene fatty acid amide, amine oxide, and polyoxyethylene alkylamine.

A pigment may be microencapsulated by coating it with a resin having a hydrophilic radical. Microencapsulating gives the pigment dispersibility.

Any of conventional methods may be used to coat a water-insoluble pigment with an organic polymer and thereby to microencapsulate the water-insoluble pigment. Such conventional methods include chemical manufacturing methods, physical manufacturing methods, physicochemical manufacturing methods, and mechanical manufacturing methods. For example, the following methods may be used: Interface polymerization method, In-situ polymerization method, In-liquid curing coating method, Coacervation (phase separation) method, In-liquid drying method, Melting-dispersion-cooling process, In-air suspension coating method, Spray drying method, Acidification deposition method and Phase inversion emulsification.

Interface polymerization method: two types of monomers or two types of reactants are dissolved in a disperse phase and a continuous phase separately, and are caused to react with each other at the interface between the two phases and thereby to form wall membranes. In-situ polymerization method: aqueous or gaseous monomers and catalysts or two types of reactive substances are supplied from either the continuous phase side or the nuclear particle side, and are caused to react with each other and thereby to form wall membranes. In-liquid curing coating method: wall membranes are formed by insolubilizing drops of polymer solution containing core material particles in a liquid using a curing agent.

Coacervation (phase separation) method: wall membranes are formed by separating a polymer dispersed liquid, where core material particles are dispersed, into coacervate (dense phase) with a high polymer concentration and a dilute phase. In-liquid drying method: a core material is dispersed in a solution of a wall membrane material, the core material dispersed liquid is put in another liquid, in which the continuous phases of the core material dispersed liquid do not blend, to form a multiple emulsion, then the medium in which the wall membrane material is dissolved is gradually removed to form wall membranes.

Melting-dispersion-cooling process: a wall membrane material that melts when heated and solidifies at normal temperature is liquefied by heating, core material particles are dispersed in the resulting liquid, and then the liquid is changed into fine particles and cooled to form wall membranes. In-air suspension coating method: powder of core material particles are suspended in air using a fluid bed, and a coating liquid used as a wall membrane material is sprayed in the air to form wall membranes.

Spray drying method: an undiluted encapsulation liquid is sprayed and brought into contact with heated air to evaporate its volatile matter content and thereby to form wall membranes. Acidification deposition method: an organic polymer, at least a part of the anionic groups of which is neutralized with a basic compound to give it water solubility, is kneaded together with a colorant in an aqueous medium, neutralized or acidified using an acidic compound so that the organic polymer is deposited and fixed to the colorant, and then neutralized again and dispersed. Phase inversion emulsification: water is put in an organic solvent phase made of a mixture of a colorant and an anionic organic polymer having water dispersibility, or the organic solvent phase is put in water.

As a material for the wall membrane of a microcapsule, the following organic polymers (resins) may be used: polyamide, polyurethane, polyester, polyurea, epoxy resin, polycarbonate, urea resin, melamine resin, phenolic resin, polysaccharide, gelatin, acacia gum, dextran, casein, protein, natural rubber, carboxypolymethylene, polyvinyl alcohol, polyvinyl pyrrolidone, polyvinyl acetate, polyvinyl chloride, polyvinylidene chloride, cellulose, ethyl cellulose, methyl cellulose, cellulose nitrate, hydroxyethyl cellulose, cellulose acetate, polyethylene, polystyrene, polymer or copolymer of (metha)acrylic acid, polymer or copolymer of (metha)acrylic acid ester, (metha)acrylic acid-(metha)acrylic acid ester copolymer, styrene-(metha)acrylic acid copolymer, styrene-maleic acid copolymer, alginic acid soda, fatty acid, paraffin, bees wax, water wax, hardened tallow, carnauba wax, and albumin.

Among the above organic polymers, ones having an anionic group such as a carboxylic group or a sulfonic group may be used. Also, nonionic organic polymers such as polyvinyl alcohol, polyethylene glycol monomethacrylate, polypropylene glycol monomethacrylate, methoxypolyethylene glycol monomethacrylate, (co)polymers of the preceding substances, and cationic ring-opening polymer of 2-oxazoline may be used. Completely saponified polyvinyl alcohol has a low water solubility (it is easily soluble in hot water but not in cold water) and therefore is especially preferable.

The amount of an organic polymer in a wall membrane material for microencapsulation is preferably 1-20 mass percent of a water-insoluble colorant such as an organic pigment or carbon black. Keeping the amount of an organic polymer coating the surface of a pigment within the above range prevents the organic polymer from inhibiting the color development of the pigment. When the amount of an organic polymer is less than 1 mass percent, the effect of encapsulation becomes insufficient. When the amount of an organic polymer is more than 20 mass percent, the color development of a pigment is inhibited. If other factors are also taken into account, the amount of an organic polymer is more preferably 5-10 mass percent of a water-insoluble colorant.

With the amount of an organic polymer within the above range, a part of a colorant is virtually not coated or virtually exposed, and therefore the color development of the colorant is not inhibited. From a different point of view, a colorant is virtually coated or virtually not exposed, and therefore a sufficient encapsulation effect can be obtained. The number average molecular weight of an organic polymer is preferably 2000 or more to efficiently perform encapsulation.

Using a self-dispersing organic pigment or a self-dispersing carbon black as a colorant provides high dispersibility to a microencapsulated pigment even when the content of an organic polymer in a capsule is relatively low.

Therefore, a self-dispersing organic pigment and a self-dispersing carbon black are preferable as colorants to provide sufficient preservation stability to an ink.

It is preferable to select an appropriate organic polymer depending on the method of microencapsulation. For the interface polymerization method, for example, polyester, polyamide, polyurethane, polyvinyl pyrrolidone, and epoxy resin are preferable. For the in-situ polymerization method, polymer or copolymer of (metha)acrylic acid ester, (metha) acrylic acid-(metha)acrylic acid ester copolymer, styrene-(metha)acrylic acid copolymer, polyvinyl chloride, polyvinylidene chloride, and polyamide are preferable. For the in-liquid curing coating method, alginic acid soda, polyvinyl alcohol, gelatin, albumin, and epoxy resin are preferable. For the coacervation method, gelatin, cellulose, and casein are preferable. Other microencapsulation methods may also be used to obtain a fine, and uniform microencapsulated pigment.

For the phase inversion emulsification method and the acidification deposition method, anionic organic polymers may be used. In the phase inversion emulsification method, a mixture of an anionic organic polymer having self-dispersibility or solubility in water and a colorant such as a self-dispersing organic pigment or a self-dispersing carbon black; or a mixture of a colorant such as a self-dispersing organic pigment or a self-dispersing carbon black, a curing agent, and an anionic organic polymer, is used as an organic solvent phase. Water is put in the organic solvent phase or the organic solvent phase is put in water. The organic solvent phase self-disperses (inversion emulsification) and the colorant is microencapsulated. In the phase inversion emulsification method, a recording liquid vehicle or additives may also be mixed in the organic solvent phase. To directly produce a dispersion liquid for a recording liquid, it is preferable to mix a recording liquid medium.

In the acidification deposition method, a part or all of the anionic group of an organic polymer is neutralized with a basic compound; the organic polymer is kneaded together with a colorant such as a self-dispersing organic pigment or a self-dispersing carbon black in an aqueous medium; and the pH of the organic polymer is neutralized or acidified using an acidic compound so that the organic polymer is deposited and fixed to the colorant. Then, a part or all of the anionic groups of the resulting hydrated cake is neutralized with a basic compound so that the colorant is microencapsulated. As a result, an aqueous dispersion liquid containing fine microencapsulated anionic pigment is produced.

As a solvent in the above described microencapsulation methods, the following substances may be used: an alkyl alcohol such as methanol, ethanol, propanol, or butanol; an aromatic hydrocarbon such as benzole, toluole, or xylole; an ester such as methyl acetate, ethyl acetate, or butyl acetate; a chlorinated hydrocarbon such as chloroform or ethylene dichloride; a ketone such as acetone or methyl isobutyl ketone; an ether such as tetrahydrofuran or dioxane; and a cellosolve such as methyl cellosolve or butyl cellosolve. Microcapsules prepared as described above are separated from the solvent by centrifugation or filtration. The separated microcapsules are stirred together with water and a solvent to form a recording liquid. The average particle diameter of a microencapsulated pigment prepared as described above is preferably between 50 and 180 nm.

Such a pigment coated with a resin as described above adheres firmly onto a recording medium and thereby improves abrasion resistance of a printed matter.

[Dye]

As a dye used for recording liquid, dyes classified in acidic dyes, direct dyes, basic dyes, reactive dyes and food colors in color indices and having excellent water resistance and light fastness are used. Plural kinds of these dyes may be mixed and used or, if necessary, may be mixed and used with another color material such as a pigment. Such a coloring agent is added in a range such that the effect of the present invention is not inhibited.

(a) As acidic dyes and food colors,

C.I. acid yellows 17, 23, 42, 44, 79, and 142,

C.I. acid reds 1, 8, 13, 14, 18, 26, 27, 35, 37, 42, 52, 82, 87, 89, 92, 97, 106, 111, 114, 115, 134, 186, 249, 254, and 289, C.I. acid blues 9, 29, 45, 92, and 249, C.I. acid blacks 1, 2, 7, 24, 26, and 94, C.I. food yellows 3 and 4, C.I. food reds 7, 9, and 14, and C.I. food blacks 1 and 2, etc., can be used.

(b) As direct dyes,

C.I. direct yellows 1, 12, 24, 26, 33, 44, 50, 86, 120, 132, 142, and 144,

C.I. direct reds 1, 4, 9, 13, 17, 20, 28, 31, 39, 80, 81, 83, 89, 225, and 227,

C.I. direct oranges 26, 29, 62, and 102,

C.I. direct blues 1, 2, 6, 15, 22, 25, 71, 76, 79, 86, 87, 90, 98, 163, 165, 199, and 202, and C.I. direct blacks 19, 22, 32, 38, 51, 56, 71, 74, 75, 77, 154, 168, and 171, etc., can be used.

(C) As basic dyes,

C.I. basic yellows 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91, C.I. basic reds 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112, C.I. basic blues 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155, and C.I. basic blacks 2 and 8, etc., can be used.

(d) As reactive dyes,

C.I. reactive blacks 3, 4, 7, 11, 12, and 17,

C.I. reactive yellows 1, 5, 11, 13, 14, 20, 21, 22, 25, 40, 47, 51, 55, 65, and 67, C.I. reactive reds 1, 14, 17, 25, 26, 32, 37, 44, 46, 55, 60, 66, 74, 79, 96, and 97, and C.I. reactive blues 1, 2, 7, 14, 15, 23, 32, 35, 38, 41, 63, 80, and 95, etc., can be used.

[Additives and Physical Properties Common to Pigments and Dyes]

It is preferable to use a water-soluble organic solvent as well as a coloring material for the purposes of providing recording liquid used for an image forming apparatus according to the present invention with a desired physical property or preventing clogging in a nozzle of a recording head which is caused by the drying of the recording liquid. The water-soluble organic solvent may include a wetting agent or a penetrating agent. The wetting agent is added for the purpose of preventing clogging in a nozzle of a recording head which is caused by the drying of the recording liquid.

Specific examples of the wetting agents are polyhydric alcohols such as ethylene glycol, diethylene glycol, triethylene glycol, tetraethylene glycol, polyethylene glycol, propylene glycol, 1,3-butanediol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3-hexanediol, 1,2,4-butanetriol, 1,2,3-butanetriol, and petriols; polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether, and propylene glycol monoethyl ether; polyhydric alcohol aryl ethers such as ethylene glycol monophenyl ether and ethylene glycol monobenzyl ether; nitrogen-containing heterocyclic compounds such as N-methyl-2-pyrrolidone, N-hydroxyethyl-2-pyrrolidone, 2-pyrrolidone, 1,3-dimethylimidazolidinone, and ε-caprolactam; amides such as formamide, N-methylformamide, and N,N-dimethylformamide; amines such as monoethanolamine, diethanolamine, triethanolamine, monoethylamine, diethylamine, and triethylamine; sulfur-containing compounds such as dimethyl sulfoxide, sulfolane, and thiodiethanol; propylene carbonate, ethylene carbonate, and γ-butyrolactone. These solvents are used singularly or in combination with water.

Also, the penetrating agent is added for the purpose of improving the wettability of a material to be recorded with recording liquid and adjusting the penetration speed thereof. As a penetrating agent, penetrating agents represented by the following formulas (I)-(IV) are preferable. That is, since a polyoxyethylene alkylphenyl ether-type surfactant of the following formula (I), a acetylene glycol-type surfactant of the following formula (II), a polyoxyethylene alkyl ether-type surfactant of the following formula (III) and polyoxyethylene polyoxypropylene alkyl ether-type surfactant of the following formula (IV) can lower the surface tension of liquid, the wettability can be improved and the penetration speed can be increased.

(I)

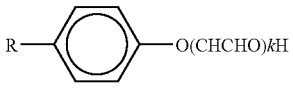

(R is a hydrocarbon chain with 6-14 carbon atoms which may be branched and k is 5-20.)

(II)

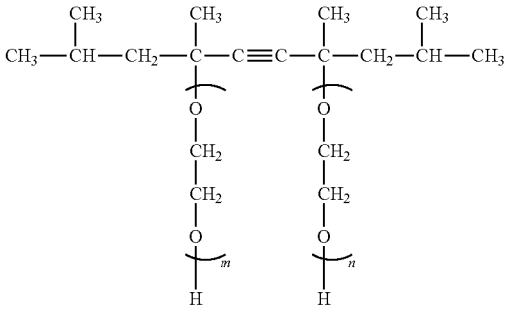

(Each of m and n is 0-40.)

$$R—(OCH_2CH_2)_nH \quad (III)$$

(R is a hydrocarbon chain with 6-14 carbon atoms which may be branched and k is 5-20.)

(IV)

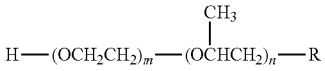

(R is a hydrocarbon chain with 6-14 carbon atoms and each of m and n is a number equal to or less than 20.)

In addition to the compounds of the formulas (I)-(IV), there can be used, for example, polyhydric alcohol alkyl or aryl ethers such as diethylene glycol monophenyl ether, ethylene glycol monophenyl ether, ethylene glycol monoallyl ether, diethylene glycol monobutyl ether, propylene glycol monobutyl ether, and tetraethylene glycol chlorophenyl ether; nonionic surfactants such as a polyoxyethylene polyoxypropylene block copolymer, fluorine-containing surfactants, and lower alcohols such as ethanol and 2-propanol, and diethylene glycol monobutyl ether is particularly preferable.

However, any surfactant may be used depending on the purpose. For example, an anion surfactant, a nonion surfactant, an amphoteric surfactant, or a fluorinated surfactant may be used. Examples of anion surfactants include polyoxyethylene alkyl ether acetate, dodecylbenzenesulfonate, laurylate, and salt of polyoxyethylene alkyl ether sulfate.

Examples of nonion surfactants include acetylene glycol surfactant, polyoxyethylene alkyl ether, polyoxyethylene alkyl phenyl ether, polyoxyethylene alkyl ester, and polyoxyethylene sorbitan fatty acid ester.

Examples of acetylene glycol surfactants include 2,4,7,9-tetramethyl-5-desine-4,7-diol, 3,6-dimethyl-4-octine-3,6-diol, and 3,5-dimethyl-1-hexin-3-ol. For example, the following acetylene glycol surfactants are available as commercialized products: Surfynol 104, 82, 465; 485, TG (Air Products and Chemicals, Inc.).

Examples of amphoteric surfactants include lauryl amino propionate, lauryl dimethyl betaine, stearyl dimethyl betaine, and lauryl dihydroxyethyl betaine. More specifically, examples of amphoteric surfactants include lauryl dimethyl amine oxide, myristyl dimethyl amine oxide, stearyl dimethyl amine oxide, dihydroxyethyl lauryl amine oxide, polyoxyethylene coconut oil alkyldimethyl amine oxide, dimethylalkyl (coconut) betaine, and dimethyl lauryl betaine.

Especially, surfactants represented by chemical formulas (V), (VI), (VII), (VIII), (IX), and (X) shown below are preferable.

$$R1\text{-}O—(CH_2CH_2O)hCH_2COOM \quad (V)$$

In chemical formula (V), R1 indicates an alkyl group with 6-14 carbon atoms. The alkyl group may be branched. h is an integer between 3 and 12. M indicates alkali metal ion, quaternary ammonium, quaternary phosphonium, or alkanolamine.

(VI)

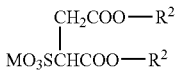

In chemical formula (VI), R2 indicates an alkyl (X)

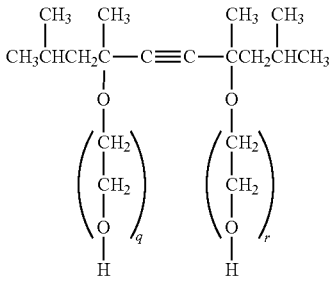

In chemical formula (X), q and r are integers between 0 and 40.

The surfactants represented by chemical formulas (V) and (VI) are shown in free acid forms below. As the surfactant (V), the following (V-1) to (V-6) can be listed.

$$CH_3(CH_2)_{12}O(CH_2CH_2O)_3CH_2COOH \quad (V\text{-}1)$$

$$CH_3(CH_2)_{12}O(CH_2CH_2O)_4CH_2COOH \quad (V\text{-}2)$$

$$CH_3(CH_2)_{12}O(CH_2CH_2O)_5CH_2COOH \quad (V\text{-}3)$$

$$CH_3(CH_2)_{12}O(CH_2CH_2O)_6CH_2COOH \quad (V\text{-}4)$$

group with 5-16 carbon atoms. The alkyl group may be branched. M indicates alkali metal ion, quaternary ammonium, quaternary phosphonium, or alkanolamine.

(VII)

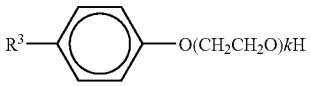

In chemical formula (VII), R3 indicates a hydrocarbon radical, for example, an alkyl group with 6-14 carbon atoms. The alkyl group may be branched. k is an integer between 5 and 20.

$$R4\text{-}(OCH_2CH_2)jOH \quad \text{(VIII)}$$

In chemical formula (VIII), R4 indicates a hydrocarbon radical, for example, an alkyl group with 6-14 carbon atoms. j is an integer between 5 and 20.

(IX)

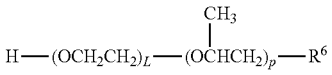

In chemical formula (IX), R6 indicates a hydrocarbon radical, for example, an alkyl group with 6-14 carbon atoms. The alkyl group may be branched. L and p are integers between 1 and 20.

(V-5)

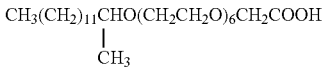

(V-6)

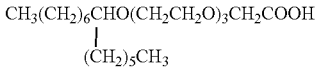

Next, as the surfactant (VI), the following (VI-1) to (VI-4) can be listed.

(VI-1)

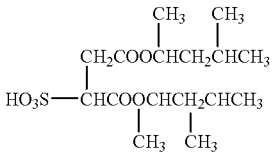

(VI-2)

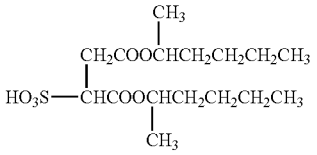

(VI-3)

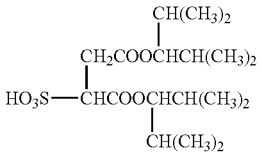

-continued (VI-4)

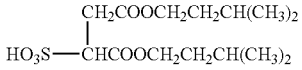

A fluorinated surfactant represented by chemical formula (A) below is preferably used.

$$CF_3CF_2(CF_2CF_2)m\text{-}CH_2CH_2O(CH_2CH_2O)nH \quad \text{(A)}$$

In chemical formula (A), m indicates an integer between 0 and 10, and n indicates an integer between 1 and 40.

Examples of fluorinated surfactant include a perfluoroalkyl sulfonic acid compound, a perfluoroalkyl carvone compound, a perfluoroalkyl phosphoric ester compound, a perfluoroalkyl ethylene oxide adduct, and a polyoxyalkylene ether polymer compound having a perfluoroalkylether group as a side chain. Among them, a polyoxyalkylene ether polymer compound having a perfluoroalkylether group as a side chain has a low foaming property and a low fluorine compound bioaccumulation potential and is therefore especially preferable in terms of safety.

Examples of perfluoroalkyl sulfonic acid compounds include perfluoroalkyl sulfonic acid and perfluoroalkyl sulfonate.

Examples of perfluoroalkyl carvone compounds include perfluoroalkyl carboxylic acid and perfluoroalkyl carboxylate.

Examples of perfluoroalkyl phosphoric ester compounds include perfluoroalkyl phosphoric ester and salt of perfluoroalkyl phosphoric ester.

Examples of polyoxyalkylene ether polymer compounds having a perfluoroalkylether group as a side chain include a polyoxyalkylene ether polymer having a perfluoroalkylether group as a side chain, a sulfate ester salt of a polyoxyalkylene ether polymer having a perfluoroalkylether group as a side chain, and a salt of a polyoxyalkylene ether polymer having a perfluoroalkylether group as a side chain.

Counter ions of salts in the above fluorinated surfactants include Li, Na, K, NH4, NH3CH2CH2OH, NH2(CH2CH2OH)2, and NH(CH2CH2OH)3.

Fluorinated surfactants created for the present invention or those available as commercial products may be used.

Commercially available fluorinated surfactants include Surflon S-111, S-112, S-113, S-121, S-131, S-132, S-141, S-145 (Asahi Glass Co., Ltd.); Fluorad FC-93, FC-95, FC-98, FC-129, FC-135, FC-170C, FC-430, FC-431 (Sumitomo 3M Limited); Megafac F-470, F1405, F-474 (Dainippon Ink and Chemicals, Incorporated); Zonyl TBS, FSP, FSA, FSN-100, FSN, FSO-100, FSO, FS-300, UR (DuPont); FT-110, FT-250, FT-251, FT-400S, FT-150, FT-400SW (NEOS Co. Ltd.); and PF-151N (Omnova Solutions, Inc.). Among them, in terms of reliability and color development, Zonyl FSN, FSO-100, and FSO (DuPont) are especially preferable.

The surface tension of a recording liquid used in the image forming apparatus according to the present invention is preferably 10-60 N/m. 15-40 N/m is more preferable based on both wettability of the recording medium and making a particle of liquid drop.

The viscosity of a recording liquid is preferably between 1.0 and 30 mPa s, and more preferably between 5.0 and 10.0 mPa s for stable spray performance.

The pH of the recording liquid is preferably between 3 and 11, and more preferably between 6 and 10 to prevent corrosion of metallic parts that contact the recording liquid.

Examples of other components in an ink include, but are not limited to, a resin emulsion, a pH adjuster, an antiseptic or a fungicide, a rust inhibitor, an antioxidant, an ultraviolet absorber, an oxygen absorber, and a light stabilizer.

A resin emulsion is made by dispersing resin microparticles in water as a continuous phase and may contain a dispersing agent such as a surfactant.

The mass percentage of the resin microparticles as a component of the disperse phase in a resin emulsion is preferably between 10 and 70%. The average particle diameter of the resin microparticles, especially for ink jet recording apparatuses, is preferably between 10 and 1000 nm, and more preferably between 20 and 300 nm.

Examples of resin microparticle materials include, but not limited to, acrylic resin, vinyl acetate resin, styrene resin, butadiene resin, styrene-butadiene resin, vinyl chloride resin, styrene-acrylic resin, and acrylic silicone resin. Especially, acrylic silicone resin is preferable.

Resin emulsions created for the present invention or those available as commercial products may be used.

Examples of commercially available resin emulsions include Microgel E-1002, E-5002 (styrene-acrylic resin emulsion, Nippon Paint Co., Ltd.); VONCOAT 4001 (acrylic resin emulsion, Dainippon Ink and Chemicals, Incorporated); VONCOAT 5454 (styrene-acrylic resin emulsion, Dainippon Ink and Chemicals, Incorporated); SAE-1014 (styrene-acrylic resin emulsion, ZEON Corporation); Saibinol SK-200 (acrylic resin emulsion, Saiden Chemical Industry Co., Ltd.); Primal AC-22, AC-61 (acrylic resin emulsion, Rohm and Haas Company); Nanocryl SBCX-2821, 3689 (acrylic silicone resin, Toyo Ink Mfg. Co., Ltd.); and #3070 (methyl methacrylate polymer resin emulsion, Mikuni Color Ltd.).

The mass percentage of the resin microparticles in a resin emulsion is preferably between 0.1 and 50%, more preferably between 0.5 and 20%, and further preferably between 1 and 10%. When the mass percentage of the resin microparticles is less than 0.1%, the resin emulsion may not be able to prevent clogging or may not be able to improve spray stability. When the mass percentage of the resin microparticles is more than 50%, the preservation stability of the ink may be reduced.

The recording liquid may also contain an antiseptic or a fungicide. Mixing an antiseptic or a fungicide prevents growth of bacteria, improves preservation stability, and thereby contributes to maintaining image quality. The following substances may be used as antiseptics or fungicides: benzotriazole, sodium dehydroacetate, sodium sorbate, 2-pyridinethiol-1-oxide sodium, isothiazolin compound, sodium benzoate, and pentachlorophenol sodium.

The recording liquid may also contain a rust inhibitor. The rust inhibitor coats the surfaces of metallic parts such as a recording head that contact the recording liquid and thereby prevents corrosion. The following substances may be used as rust inhibitors: acidic sulfite, sodium thiosulfate, ammonium thiodiglycolic acid, diisopropyl ammonium nitrite, pentaerythritol tetranitrate, and dicyclohexyl ammonium nitrite.

The recording liquid may also contain an antioxidant. The antioxidant prevents corrosion by eliminating radical species that cause corrosion.

As the antioxidant, phenolic compounds and amine compounds are mainly used. Phenolic compounds include compounds such as hydroquinone and gallate; and hindered phenolic compounds such as 2,6-di-tert-butyl-p-cresol, stearyl-β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-thiobis(3-methyl-6-tert-butylphenol), 1,1,3-tris(2-methyl-4-hydroxy-5-tert-butylphenyl)butane, 1,3,5-trimethyl-2,4,6-tris(3,5-di-tert-4-hydroxybenzyl)benzene, tris(3,5-dit-tert-butyl-4-hydroxybenzyl)isocyanurate, and tetrakis[methylene-3(3',5'-di-tert-butyl-4-hydroxyphenyl)propionate]methane. Amine compounds include N,N'-diphenyl-p-phenylenediamine, phenyl-β-naphthylamine, phenyl-α-naphthylamine, N,N'-β-naphthyl-p-phenylenediamine, N,N'-diphenylethylenediamine, phenothiazine, N,N'-di-sec-butyl-p-phenylenediamine, and 4,4'-tetramethyl-diaminodiphenylmethane. For the latter one, sulfur compounds and phosphorus compounds are mainly used. Sulfur compounds include dilauryl thiodipropionate, distearyl thiodipropionate, lauryl stearyl thiodipropionate, dimyristyl thiodipropionate, distearyl β,β-thiodibutyrate, 2-mercaptobenzoimidazole, and dilauryl sulfide. Phosphorus compounds include triphenyl phosphite, trioctadecyl phosphite, tridecyl phosphite, trilauryl trithiophosphite, diphenyl isodecyl phosphite, trinonyl phenyl phosphite, and distearyl pentaerythritol phosphite.

As pH adjusters contained in the recording liquid, the following substances may be used: hydroxides of alkali metals such as lithium hydroxide, sodium hydroxide, and potassium hydroxide; carbonates of alkali metals such as ammonium hydroxide, quaternary ammonium hydroxide, quaternary phosphonium hydroxide, lithium carbonate, sodium carbonate, and potassium carbonate; amines such as diethanolamine and triethanolamine; boric acid; hydrochloric acid; nitric acid; sulfuric acid; and acetic acid.

Examples of ultraviolet absorbers include a benzophenone ultraviolet absorber, a benzotriazole ultraviolet absorber, a salicylate ultraviolet absorber, a cyanoacrylate ultraviolet absorber, and a nickel complex salt ultraviolet absorber.

Examples of benzophenone ultraviolet absorbers include 2-hydroxy-4-n-octoxybenzophenone, 2-hydroxy-4-n-dodecyloxy benzophenone, 2,4-dihydroxybenzophenone, 2-hydroxy-4-methoxybenzophenone, and 2,2', 4,4'-tetrahydroxybenzophenone.

Examples of benzotriazole ultraviolet absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

Examples of salicylate ultraviolet absorbers include phenyl salicylate, p-tert-butylphenylsalicylate, and p-octylphenylsalicylate.

Examples of cyanoacrylate ultraviolet absorbers include ethyl-2-cyano-3,3'-diphenylacrylate, methyl-2-cyano-3-methyl-3-(p-methoxyphenyl)acrylate, and butyl-2-cyano-3-methyl-3-(p-methoxyphenyl)acrylate.

Examples of nickel complex salt ultraviolet absorbers include nickelbis(octylphenyl)sulfide, 2,2'-tiobis(4-tert-octylphalate)-n-butylaminenickel (II), 2,2'-tiobis(4-tert-octylphalate)-2-ethylhexylaminenickel (II), and 2,2'-tiobis(4-tert-octylphalate)triethanolaminenickel (II).

An ink according to an ink media set of the present invention contains at least water, a colorant, and a humectant, and may also include a penetrant, a surfactant, and other components. To prepare an ink, the above components are dispersed or dissolved in an aqueous medium. The solution may be stirred if needed. To disperse the components, for example, a sand mill, a homogenizer, a ball mill, a paint shaker, or an ultrasound dispersing machine may be used. To stir the solution, a normal stirring machine having stirring blades, magnetic stirrer, or a high-speed dispersing machine may be used.

Colors of inks include, but not limited to, yellow, magenta, cyan, and ink. A multi-color image can be formed with two or more color inks. A full-color image can be formed with the four color ink.

In the exemplary image forming apparatus configured as described above, the paper sheets 112 are separated and fed one by one from the paper feed tray 110, the separated paper sheet 112 is fed approximately vertically upward and guided by the guide 115 into the space between the conveyor belt 121 and the counter roller 122 so as to be conveyed further, the leading edge of the paper sheet 112 is guided by the conveying guide 123 and pressed by the tip pressing roller 125 onto the conveyor belt 121, and then the direction of the paper sheet 112 is changed approximately 90 degrees.

At this stage, an AC bias applying unit of a control circuit described later applies alternating voltages to the charging roller 126 by alternately outputting positive and negative voltages. As a result, positively and negatively charged strips with a constant width are formed alternately in the paper conveying direction (sub scanning direction) on the surface of the conveyor belt 121. When the paper sheet 112 is conveyed onto the charged conveyor belt 121, the paper sheet 112 is electrostatically attracted to the conveyor belt 121 and thereby conveyed in the sub scanning direction as the conveyor belt 121 turns.

The recording heads 107 are driven while moving the carriage 103 in the main scanning directions (outbound and inbound directions) according to an image signal to spray ink drops, and record a line of image on the paper sheet 112 that is paused at a position. Then, the paper sheet 112 is conveyed further a specified distance, and the next line is recorded. When a recording completion signal or a signal indicating that the bottom edge of the paper sheet 112 has reached the image forming area is received, the exemplary image forming apparatus terminates the image forming process and ejects the paper sheet 112 into the paper catch tray 154.

In duplex printing, after an image is formed on the upper side (a side of the paper sheet 112 on which an image is formed first) of the paper sheet 112, the paper sheet 112 is fed into the duplex unit 155 by turning the conveyor belt 121 in the reverse direction, the paper sheet 112 is reversed (so that the underside of the paper sheet 112 faces upward) and fed again into the space between the counter roller 122 and the conveyor belt 121, the paper sheet 112 is conveyed by the conveyor belt 121 at controlled timings as described earlier, an image is formed on the underside, and then the paper sheet 112 is ejected onto the paper catch tray 154.

When the exemplary image forming apparatus is idle, the carriage 103 is moved into a position above the recording head maintenance/cleaning mechanism 156. In the position, the nozzle surfaces of the recording heads 107 are covered by the caps 157 to retain moisture of the nozzles and thereby to prevent nozzle clogging caused by dried ink. With the recording heads 107 capped by the caps 157, the nozzles are suctioned to remove dried ink or air bubbles (it is called as nozzle suction or head suction). The ink adhered to the nozzle surfaces of the recording heads 107 during this recording head maintenance is wiped off by the wiper blade 158. Also, before or during an image forming process, ink is sprayed in order to clean the nozzles. With the above measures, the spray performance of the recording heads 107 is maintained.

In the exemplary image forming apparatus configured as described above, since the recording head is configured with the liquid drop ejecting head, miniaturization and low cost can be planned for the image forming apparatus.

Figure 17:
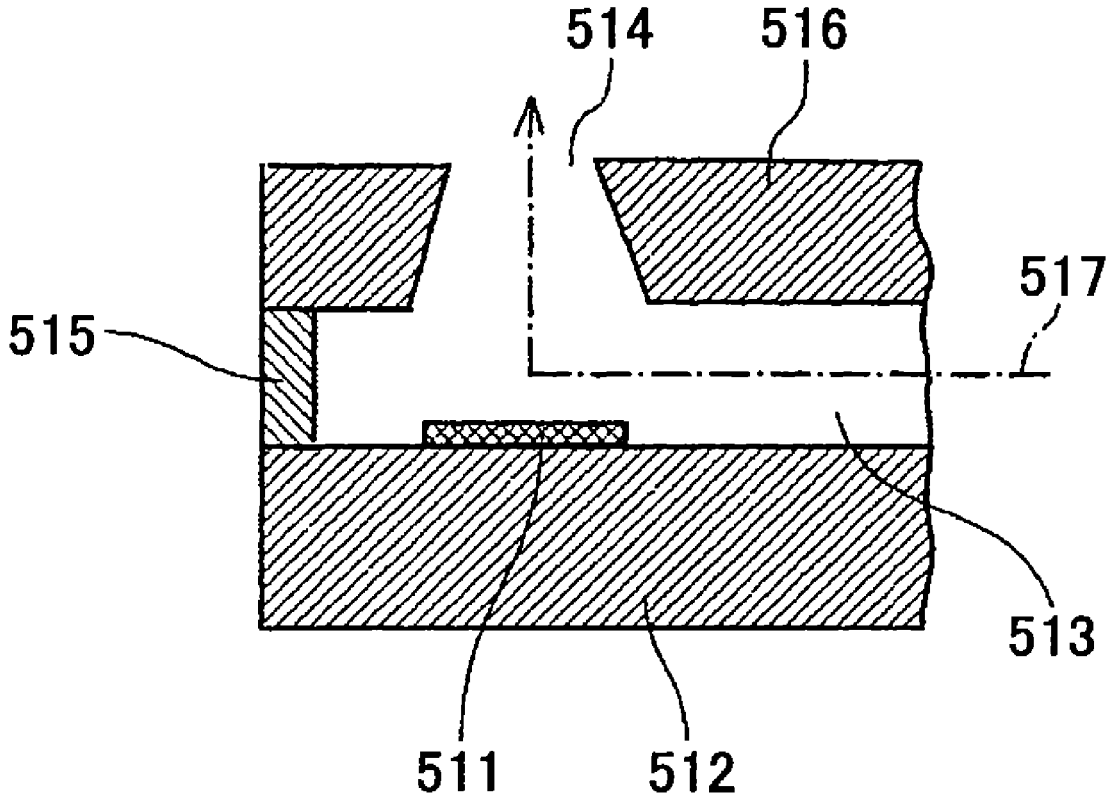
FIG. 17 is a sectional view showing essential parts of other embodiment of the liquid drop ejecting head of the present invention.

Next, as the liquid drop ejecting head same as the above described embodiment using different side shooter mechanism which has different directions of ejection of liquid drop and the recording liquid channel (liquid chamber), one example of thermal typed head in which energy occurring means (drive element) to eject liquid drop is an electric heat conversion body is explained reference with FIG. 17.

For the structure of the liquid drop ejecting head, a channel forming member 515 comprising side wall of channel 513 is laminated on a board 512 having an ejecting energy outbreaking body 511 (electrode which applies ejecting signal to the body and protection layer provided on the body as necessary are omitted), and the nozzle plate 516 forming the nozzle 514 is laminated on the channel forming member 515. In this head, the flow direction of the ink to the ejection energy operation part in the channel 513 and a central opening axis of the nozzle 514 are configured as right angle as shown in dotted line 517.

In this head, the above described effect can be obtained by providing different water-repellent process between the nozzle forming part and the outer circumferential part of the nozzle plate 515. Due to a such kind of head structure, energy from the ejecting energy outbreaking body 511 can be converted more efficiently to the formation of the ink drop and kinetic energy of the flight of the ink drop, a structural advantage that is fast return of a meniscus by supply of ink is provided, and especially it is more effective in the case of using a heating element to the ejecting energy outbreaking body 511. Also, when the side shooter mechanism is used, so-called cavitation phenomenon, in which the ejecting energy outbreaking body is slowly destroyed by a shock when air bubbles which are problem in an edge shooter are disappeared, can be evaded.

In other words, in the side shooter mechanism, when air bubbles grow and the reach to the nozzle, air bubbles communicate with the atmosphere, and the shrinkage of air bubbles by a temperature fall does not happen thereby lifetime of the head relatively gets longer.

In the above embodiment, the present invention is explained in example applied for the image forming apparatus like printer, but the present invention is not limited to. For example, the present invention can be applied to the image forming apparatus like a multi device comprising printer, fax, and copy. Also, the present invention can be applied to the liquid drop ejecting apparatus using the recording liquid and a fixing process liquid like liquid except ink and the image forming apparatus.

Next, the recording method of the present invention is explained. In the recording method of the present invention, as the above described the image forming apparatus, image is recorded on the recording medium (paper sheet) by ejecting liquid drop from the liquid drop ejecting head of the present invention.

Here, the relationship between the nozzle plate, the recording liquid (herein, ink) and the recording medium (so-called media) of the liquid drop ejecting head of the present invention is explained. As described above, the nozzle plate of the liquid drop ejection head of the present invention has excellent water repellency (or ink repellency) and therefore can form ink drops normally even when an ink with a low surface tension is used. More specifically, a nozzle plate of the liquid drop ejection head of the present invention has low wettability and therefore a meniscus of an ink is formed normally. A normally formed meniscus prevents the ink from being drawn to one side, prevents bending of an ink stream, and thereby makes it possible to accurately form a dot.

When an image is formed on a paper sheet (medium) with a low ink-absorption rate, the positional accuracy of dots greatly affects the quality of the image. On a recording medium with a low ink-absorption rate, ink drops do not spread smoothly. Therefore, if the positional accuracy of dots is low, some parts in an image forming area on the recording medium may not be filled by the ink drops and, as a result, may be left blank. The parts left blank cause irregularity or decrease of the image density, and thereby degrade the image quality.

The nozzle plate of the liquid drop ejecting head of the present invention makes it possible to form dots with high positional accuracy even with an ink having a low surface tension; prevents irregularity or decrease of image density; and thereby makes it possible to form a high-quality image even on a paper sheet with a low ink-absorption rate.

In the below, the recording medium (medium for recording) used in the recording method of the present invention is explained.

The recording medium is composed of a base material and at least one coating layer on a surface of the base material. Also, the exemplary recording medium may have additional layers.

When the exemplary recording medium was brought into contact with an ink of this embodiment for 100 ms, the amount of the ink transferred onto the exemplary recording medium measured by a dynamic scanning absorptometer was between 2 and 40 ml/m$^2$. This value is preferably between 3 and 30 ml/m$^2$. The amount of pure water transferred onto the exemplary recording medium at a contact time of 100 ms is preferably between 2 and 45 ml/m$^2$, and more preferably between 3 and 30 ml/m$^2$. When the amount of transferred pure water or ink at a contact time of 100 ms is smaller than the preferable range, beading may occur. When the amount is larger than the preferable range, the diameter of a recorded ink dot may become smaller than a preferable diameter.

When the exemplary recording medium was brought into contact with an ink of this embodiment for 400 ms, the amount of the ink transferred onto the exemplary recording medium measured by a dynamic scanning absorptometer was between 3 and 50 ml/m$^2$. This value is preferably between 4 and 40 ml/m$^2$. The amount of pure water transferred onto the exemplary recording medium at a contact time of 400 ms is preferably between 3 and 50 ml/m$^2$, and more preferably between 4 and 40 ml/m$^2$. When the amount of transferred pure water or ink at a contact time of 400 ms is smaller than the preferable range, drying property becomes insufficient and spur marks may appear. When the amount is larger than the preferable range, bleeding may occur and the glossiness of an image after dried may become low.

Dynamic scanning absorptometer (DSA: JAPAN TAPPI JOURNAL, Volume 48, May 1994, pp. 88-92, Shigenori Kuga) is an apparatus that can accurately measure the amount of a liquid absorbed during a very short period of time. The dynamic scanning absorptometer directly reads the absorption speed of a liquid from the movement of a meniscus in a capillary and automatically measures the amount of the liquid absorbed. The test sample is shaped like a disc. The dynamic scanning absorptometer scans the test sample by moving an liquid-absorbing head spirally over the test sample and thereby measures the amount of the liquid absorbed at as many points as necessary. The scanning speed is automatically changed according to a predetermined pattern. A liquid supplying head that supplies liquid to the test sample is connected via a Teflon® tube to the capillary.

Positions of the meniscus in the capillary are automatically detected by an optical sensor. In the above experiment, a dynamic scanning absorptometer (K350 series, type D, Kyowa Co., Ltd.) was used to measure the amount of transferred pure water or ink. The amount of transferred pure water or ink at a contact time of 100 ms or 400 ms is obtained by interpolation, using the transferred amounts measured at time points around each contact time. The measurement was performed in an environmental condition of 23 degree Celsius and 50% RH.

<Base Material>

Various materials may be used for the base material depending on the purpose of paper. For example, a sheet of paper mainly made of wood fibers and a nonwoven fabric mainly made of wood and synthetic fibers may be used.

A sheet of paper may be made of wood pulp or recycled pulp. Examples of wood pulp are leaf bleached kraft pulp (LBKP), needle bleached kraft pulp (NBKP), NBSP, LBSP, GP, and TMP.

As materials of recycled pulp, recycled papers in the list of standard qualities of recycled papers of the Paper Recycling Promotion Center may be used. For example, chemical pulp or high-yield pulp made of recycled papers may be used as the base material. Such recycled papers include printer papers such as non-coated computer paper, thermal paper, and pressure-sensitive paper; OA papers such as plain paper; coated papers such as art paper, ultra-lightweight coated paper, and matte paper; and non-coated papers such as bond paper, color bond paper, note paper, letter paper, warpping paper, fancy paper, medium quality paper, newspaper, woody paper, supermarket flyers, simili paper, pure-white roll paper, and milk cartons. The above materials may be used individually or in combination.

Normally, recycled pulp is made by the following four steps:

(1) A defibrating step of breaking down used paper into fibers and separating ink from the fibers by using a mechanical force and a chemical in a pulper.
(2) A dust removing step of removing foreign substances (such as plastic) and dust in the used paper by using, for example, a screen and a cleaner.
(3) A deinking step of expelling the ink separated by a surfactant from the fibers by using a flotation method or a cleaning method.
(4) A bleaching method of bleaching the fibers by oxidization or reduction.

When mixing recycled pulp with wood pulp, the percentage of recycled pulp is preferably 40% or lower so that produced paper does not curl after recording.

As an internal filler for the base material, a conventional white pigment may be used. For example, the following substances may be used as a white pigment: an inorganic pigment such as precipitated calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithophone, zeolite, magnesium carbonate, or magnesium hydrate; and an organic pigment such as styrene plastic pigment, acrylic plastic pigment, polyethylene, microcapsule, urea resin, or melamine resin. The above substances may be used individually or in combination.

As an internal sizing agent used when producing the base material, a neutral rosin size used for neutral papermaking, alkenyl succinic anhydride (ASA), alkyl ketene dimer (AKD), or a petroleum resin size may be used. Especially, a neutral rosin size and alkenyl succinic anhydride are preferable. Alkyl ketene dimer has a high sizing effect and therefore provides an enough sizing effect with a small amount. However, since alkyl ketene dimer reduces the friction coefficient of the surface of recording paper (medium), recording paper made using alkyl ketene dimer may cause a slip when being conveyed in an ink jet recording apparatus.

<Coating Layer>

The coating layer contains a pigment and a binder, and may also contain a surfactant and other components.

As a pigment, an inorganic pigment or a mixture of an inorganic pigment and an organic pigment may be used.

For example, kaolin, talc, heavy calcium carbonate, precipitated calcium carbonate, calcium sulfite, amorphous silica, alumina, titanium white, magnesium carbonate, titanium dioxide, aluminum hydroxide, calcium hydrate, magnesium hydrate, zinc hydroxide, or chlorite may be used as an inorganic pigment. Especially, kaolin provides a high gloss surface similar to that of an offset paper and is therefore preferable.

There are several types of kaolin, for example, delaminated kaolin, calcined kaolin, and engineered kaolin made by surface modification. To provide a high gloss surface, the mass percentage of a type of kaolin, in which 80 or more mass percent of particles have a diameter of 2 μm or smaller, in the total amount of kaolin is preferably 50 percent or more.

The mass ratio of the binder to kaolin in the coating layer is preferably 100:50. If the mass ratio of kaolin is lower than 50, sufficient glossiness may not be obtained. There is no specific limit to the amount of kaolin. However, when the fluidity and the thickening property of kaolin under a high shearing force are taken into account, the mass ratio of kaolin is preferably 90 or lower in terms of coatability.

As an organic pigment, a water-soluble dispersion of, for example, styrene-acrylic copolymer particles, styrene-butadiene copolymer particles, polystyrene particles, or polyethylene particles may be used. The above organic pigments may be used in combination.

The amount of an organic pigment in the total amount of pigment in the coating layer is preferably 2-20 mass percent. An organic pigment as described above has a specific gravity lower than that of an inorganic pigment and therefore provides a thick, high-gloss coating layer having a good coatability. If the mass percentage of an organic pigment is less than 2 percent, a desired effect is not obtained. If the mass percentage of an organic pigment is more than 20 percent, the fluidity of a coating liquid becomes too low and, as a result, the efficiency of a coating process decreases and the operational costs increase.

Organic pigments can be divided into several types according to their particle shapes: solid-shape, hollow-shape, and doughnut-shape. To achieve a good balance between the glossiness, coatability, and fluidity of a coating liquid, an organic pigment having hollow-shaped particles with a void percentage of 40 percent or higher and an average diameter of between 0.2 and 3.0 μm is preferable.

As a binder, a water-based resin is preferably used.

As a water-based resin, a water-soluble resin or a water-dispersible resin may be used. Any type of water-based resin may be used depending on the purpose. For example, the following water-based resins may be used: polyvinyl alcohol; a modified polyvinyl alcohol such as anion-modified polyvinyl alcohol, cation-modified polyvinyl alcohol, or acetal-modified polyvinyl alcohol; polyurethane; polyvinyl pyrrolidone; a modified polyvinyl pyrrolidone such as polyvinyl pyrrolidone-vinyl acetate copolymer, vinyl pyrrolidone-dimethylaminoethyl methacrylate copolymer, quaternized vinyl pyrrolidone-dimethylaminoethyl methacrylate copolymer, or vinyl pyrrolidone-methacrylamide propyl trimethyl ammonium chloride copolymer; cellulose such as carboxymethyl cellulose, hydroxyethyl cellulose, or hydroxypropylcellulose; modified cellulose such as cationized hydroxyethyl cellulose; polyester, polyacrylic acid (ester), melamine resin, or modified versions of these substances; synthetic resin made of polyester-polyeurethane copolymer; and other substances such as poly(metha)acrylic acid, poly(metha)acrylamide, oxidized starch, phosphorylated starch, self-denatured starch, cationized starch, other modified starches, polyethylene oxide, polyacrylic acid soda, and alginic acid soda. The above substances may be used individually or in combination.

Among the above substances, polyvinyl alcohol, cation-modified polyvinyl alcohol, acetal-modified polyvinyl alcohol, polyester, polyurethane, and polyester-polyeurethane copolymer are especially preferable in terms of ink-absorption rate.

Any type of water-dispersible resin may be used depending on the purpose. For example, the following water-dispersible resins may be used: polyvinyl acetate, ethylene-polyvinyl acetate copolymer, polystyrene, styrene-(metha)acrylic ester copolymer, (metha)acrylic ester polymer, polyvinyl acetate-(metha)acrylic acid (ester) copolymer, styrene-butadiene copolymer, an ethylene-propylene copolymer, polyvinyl ether, and silicone-acrylic copolymer. A water-dispersible resin may contain a cross-linking agent such as methylol melamine, methylol hydroxypropylene urea, or isocyanate. Also, a self-crosslinking copolymer containing a unit of methylol acrylamide may be used as a water-dispersible resin. Two or more of the water-dispersible resins described above may be used at the same time.

The mass ratio of the water-based resin to the pigment in the coating layer is preferably 2:100 to 100:100, and more preferably 3:100 to 50:100. The amount of the water-based resin in the coating layer is determined so that the liquid-absorption rate of a recording medium falls within a specific range.

When a water-dispersible colorant is used, whether to mix a cationic organic compound in the binder is optional. For example, primary to tertiary amines that react with sulfonic groups, carboxyl groups, or amino groups of a direct dye or an acid dye in a water-soluble ink, and form insoluble salt; or a monomer, oligomer, or polymer of quarternary ammonium salt may be used. Among them, an oligomer and a polymer of quarternary ammonium salt are especially preferable.

As a cationic organic compound, the following substances may be used: dimethylamine-epichlorohydrin polycondensate, dimethylamine-ammonia-epichlorohydrin condensate, poly(trimethyl aminoethyl-methacrylate methylsulfate), diallylamine hydrochloride-acrylamide copolymer, poly(diallylamine hydrochloride-sulfur dioxide), polyallylamine hydrochlorid, poly(allylamine hydrochlorid-diallylamine hydrochloride), acrylamide-diallylamine copolymer, polyvinylamine copolymer, dicyandiamide, dicyandiamide-ammonium chloride-urea-formaldehyde condensate, polyalkylene polyamine-dicyandiamide ammonium salt condensate, dimethyl diallyl ammonium chloride, poly diallyl methyl amine hydrochloride, poly(diallyl dimethyl ammonium chloride), poly (diallyl dimethyl ammonium chloride-sulfur dioxide), poly (diallyl dimethyl ammonium chloride-diallyl amine hydrochloride derivative), acrylamide-diallyl dimethyl ammonium chloride copolymer, acrylate-acrylamide-diallyl amine hydrochloride copolymer, polyethylenimine, ethylenimine derivative such as acrylamine polymer, and modified polyethylenimine alkylene oxide. The above substances may be used individually or in combination.

It is preferable to use a cationic organic compound with a low-molecular weight such as dimethylamine-epichlorohydrin polycondensate or polyallylamine hydrochlorid and a cationic organic compound with a relatively-high molecular weight such as poly(diallyl dimethyl ammonium chloride) in combination. Compared with a case where only one cationic organic compound is used, using cationic organic compounds in combination improves image density and reduces feathering.

The equivalent weight of cation in a cationic organic compound obtained by the colloid titration method (performed using polyvinyl potassium sulfate and toluidine blue) is preferably between 3 and 8 meq/g. With an equivalent weight in the above range, the dry deposit mass of the cationic organic compound falls within a preferable range. In the measurement of the equivalent weight of cation, the cationic organic compound is diluted with distillated water so that the solid content in the solution becomes 0.1 mass percent. No pH control is performed.

The dry deposit mass of the cationic organic compound is preferably between 0.3 and 2.0 g/m$^2$. If the dry deposit mass of the cationic organic compound is lower than 0.3 g/m$^2$, sufficient improvement in image density and sufficient reduction in feathering may not be achieved.

Any surfactant may be used depending on the purpose. For example, an anion surfactant, a cation surfactant, an amphoteric surfactant, or a nonionic surfactant may be used. Among the above surfactants, a nonionic surfactant is especially preferable. Adding a surfactant improves water resistance and density of an image, and thereby reduces bleeding.

For example, the following nonionic surfactants may be used: higher alcohol ethylene oxide adduct, alkylphenol ethylene oxide adduct, fatty acid ethylene oxide adduct, polyhydric alcohol fatty acid ester ethylene oxide adduct, higher aliphatic amine ethylene oxide adduct, fatty acid amide ethylene oxide adduct, fatty oil ethylene oxide adduct, ethylene oxide adduct of fat, polypropylene glycol ethylene oxide adduct, glycerol fatty acid ester, pentaerythritol fatty acid ester, sorbitol-sorbitan fatty acid ester, sucrose fatty acid ester, polyhydric alcohol alkyl ether, and alkanolamine fatty acid amide. The above substances may be used individually or in combination.

Polyhydric alcohol is not limited to a specific type and any type of polyhydric alcohol may be used depending on the purpose. For example, glycerol, trimethylolpropane, pentaerythrite, sorbitol, or sucrose may be used. Ethylene oxide adduct may be made by replacing a part of ethylene oxide with an alkylene oxide such as propylene oxide or butylene oxide to the extent that the water solubility is not affected. The percentage of the replaced part is preferably 50 percent or lower. The hydrophile-lipophile balance (HLB) of a nonionic surfactant is preferably between 4 and 15, and more preferably between 7 and 13.

The mass ratio of the surfactant to the cationic organic compound is preferably 0:100 to 10:100, and more preferably 0.1:100 to 1:100.

Other components may also be added to the coating layer to the extent that its advantageous effects are not undermined. Examples of other components include additives such as an alumina powder, a pH adjuster, an antiseptic agent, and an antioxidant.

The method of forming the coating layer is not limited to a specific method. For example, the coating layer may be formed by impregnating the base material with a coating liquid or by applying a coating liquid to the base material. For the impregnation or application of a coating liquid, a coater such as a conventional size press, a gate roll size press, a film transfer size press, a blade coater, a rod coater, an air knife coater, or a curtain coater may be used. Also, using a conventional size press, a gate roll size press, or a film transfer size press attached to a paper machine for the impregnation or application of a coating liquid may improve the efficiency of the process.

There is no specific limit to the amount of a coating liquid on the base material. However, the solid content of a coating liquid on the base material is preferably between 0.5 and 20 g/m$^2$, and more preferably between 1 and 15 g/m$^2$. After the impregnation or application of a coating liquid, the coating liquid may be dried. The temperature for this drying process is preferably between 100 and 250 degree Celsius, but is not limited to the specific range.

The exemplary recording medium used in the recording method of the present invention may also have a back layer on the back of the base material, and other layers between the base material and the coating layer or between the base material and the back layer. Also, a protective layer may be provided on the coating layer. Each of the layers may be composed of one layer or multiple layers.

In the case that absorbency of liquid is within the above range of invention, the recording medium used in the recording method of the present invention may be commercially available coated paper for offset printing, coated paper for gravure other than recording medium used for ink jet.

It is preferable that grammage of the recording medium used in the recording method of the present invention is between 50 and 250 g/m$^2$. When it is less than 50 g/m$^2$, it is easy to produce poor transportation that the recording medium is clogged on the way of a transportation course so that there is no strength. When the grammage of the recording medium is over than 250 g/m$^2$, the recording medium cannot finish turning in a curve part on the way of the transportation course so that the strength of paper becomes too strong thereby it is easy to produce poor transportation that the recording medium is clogged.

Detailed embodiments of the present invention are described below. However, the present invention is not limited to the specifically disclosed embodiments.

Preparation Example 1

-Preparation of Dispersion of Polymer Microparticles Containing Copper Phthalocyanine Pigment- To prepare a dispersion of polymer microparticles containing a copper phthalocyanine pigment, the air in a 1 L flask with a mechanical stirrer, a thermometer, a nitrogen gas inlet tube, a reflux tube, and a dropping funnel was replaced sufficiently with nitrogen gas; the 1 L flask was charged with 11.2 g of styrene, 2.8 g of acrylic acid, 12.0 g of lauryl methacrylate, 4.0 g of polyethylene glycol methacrylate, 4.0 g of styrene macromer (Toagosei Co., Ltd., brand name: AS-6), and 0.4 g of mercaptoethanol; and the temperature was raised to 65 degree Celsius. Then, a mixed solution of 100.8 g styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (Toagosei Co., Ltd., brand name: AS-6), 3.6 g of mercaptoethanol, 2.4 g of azobisdimethylvaleronitrile, and 18.0 g of methyl ethyl ketone was dripped into the 1 L flask for 2.5 hours.

After the dripping was completed, a mixed solution of 0.8 g of azobisdimethylvaleronitrile and 18.0 g of methyl ethyl ketone was dripped into the 1 L flask for 0.5 hours. The resulting solution was matured for 1 hour at the temperature of 65 degree Celsius, 0.8 g of azobisdimethylvaleronitrile was added to the solution, and then the solution was matured further for 1 hour. After the reaction stopped, 364 g of methyl ethyl ketone was put into the 1 L flask. As a result, 800 g of polymer solution with a concentration of 50 mass % was obtained. A portion of the obtained polymer solution was dried and its weight-average molecular weight (Mw) was measured by gel permeation chromatography (standard:

polystyrene, solvent: tetrahydrofuran). The weight-average molecular weight was 15,000.

Next, 28 g of the obtained polymer solution, 26 g of copper phthalocyanine pigment, 13.6 g of 1 mol/L potassium hydroxide solution, 20 g of methyl ethyl ketone, and 30 g of ion-exchanged water were mixed and stirred sufficiently. The resulting substance was kneaded 20 times using the Tripole Roll Mill (Noritake Co., Limited, brand name: NR-84A). The obtained paste was put in 200 g of ion-exchanged water and stirred. Methyl ethyl ketone and water in the liquid was distilled away by using an evaporator. As a result, 160 g of polymer microparticle dispersion with a cyan color was obtained. The solid content of the polymer microparticle dispersion was 20.0 mass %.

The average particle diameter (D50%) of the polymer microparticles in the polymer microparticle dispersion was measured with a particle size distribution analyzer (Microtrac UPA, Nikkiso Co., Ltd.). The average particle diameter was 93 nm.

Preparation Example 2

-Preparation of Dispersion of Polymer Microparticles Containing Dimethyl Quinacridone Pigment- A polymer microparticle dispersion with magenta color was prepared in substantially the same manner as the preparation example 1, except that C. I. Pigment Red 122 was used instead of a copper phthalocyanine pigment.

The average particle diameter (D50%) of the polymer microparticles in the polymer microparticle dispersion was measured with a particle size distribution analyzer (Microtrac UPA, Nikkiso Co., Ltd.). The average particle diameter was 127 nm.

Preparation Example 3

-Preparation of Dispersion of Polymer Microparticles Containing Monoazo Yellow Pigment- A polymer microparticle dispersion with a yellow color was prepared in substantially the same manner as the preparation example 1, except that C. I. Pigment Yellow 74 was used instead of a copper phthalocyanine pigment.

The average particle diameter (D50%) of the polymer microparticles in the polymer microparticle dispersion was measured with a particle size distribution analyzer (Microtrac UPA, Nikkiso Co., Ltd.). The average particle diameter was 76 nm.

Preparation Example 4

Preparation of Dispersion of Carbon Black Processed with Sulfonating Agent

To prepare a carbon black dispersion, 150 g of a commercially available carbon black pigment (Printex #85, Degussa) was mixed in 400 ml of sulfolane; the solution was microdispersed with a beads mill; 15 g of amidosulfuric acid was added to the solution; and then the solution was stirred for 10 hours at 140-150 degree Celsius. The obtained slurry was put in 1000 ml of ion-exchanged water, and the solution was centrifuged at 12,000 rpm. As a result, a surface-treated carbon black wet cake was obtained. The obtained carbon black wet cake was dispersed again in 2,000 ml of ion-exchanged water; the pH of the solution was adjusted with lithium hydroxide; the solution was desalted/condensed using an ultrafilter; and then the solution was filtered with a nylon filter with an average pore diameter of 1 μm. As a result, a black carbon dispersion with a pigment concentration of 10 mass % was obtained.

The average particle diameter (D50%) of the microparticles in the carbon black dispersion was measured with a particle size distribution analyzer (Microtrac UPA, Nikkiso Co., Ltd.). The average particle diameter was 80 nm.

Production Example 1

-Production of Cyan Ink-

To produce a cyan ink, 20.0 mass % of the dispersion of polymer microparticles containing a copper phthalocyanine pigment prepared in the preparation example 1, 23.0 mass % of 3-methyl-1,3-butanediol, 8.0 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

Production Example 2

-Production of Magenta Ink-

To produce a magenta ink, 20.0 mass % of the dispersion of polymer microparticles containing a dimethyl quinacridone pigment prepared in the preparation example 2, 22.5 mass % of 3-methyl-1,3-butanediol, 9.0 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

Production Example 3

-Production of Yellow Ink-

To produce a yellow ink, 20.0 mass % of the dispersion of polymer microparticles containing a monoazo yellow pigment prepared in the preparation example 3, 24.5 mass % of 3-methyl-1,3-butanediol, 8 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-methyl-1,3-propanediol, and a certain amount of ion-exchanged water were mixed (100 mass % in total); and the mixture was filtered using a membrane filter with an average pore diameter of 0.8 μm.

Production Example 4

-Production of Black Ink-

To produce a black ink, 20.0 mass % of the carbon black dispersion prepared in the preparation example 4, 22.5 mass % of 3-methyl-1,3-butanediol, 7.5 mass % of glycerin, 2.0 mass % of 2-pyrrolidone, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-methyl-1,3-propanediol, and a certain amount of ion-exchanged water were mixed (100 mass % in total); and the mixture was filtered using a membrane filter with an average pore diameter of 0.8 μm.

The surface tensions and viscosities of the inks produced in the production examples 1 through 4 were measured as described below. The results are shown in table 1 below.

<Measurement of Viscosity>

The viscosities of the inks were measured at 25 degree Celsius with the R-500 Viscometer of Toki Sangyo Co., Ltd. (cone 1° 34'×R24, 60 rpm, after 3 minutes).

<Measurement of Surface Tension>

The static surface tensions of inks were measured at 25 degree Celsius with a surface tensiometer (CBVP-Z of Kyowa Interface Science Co., Ltd.) using a platinum plate.

TABLE 1

| | Viscosity (mPa · s) | Surface tension (mN/m) |
|---|---|---|
| Production example 1 | 8.05 | 25.4 |
| Production example 2 | 8.09 | 25.4 |
| Production example 3 | 8.11 | 25.7 |
| Production example 4 | 8.24 | 25.4 |

-Production of Base Material-

A base material with a grammage of 79 g/m$^2$ was produced using a fourdrinier from 0.3 mass % slurry made of materials in the formula below. In the size press step of the papermaking process, an oxidized starch solution was applied on the base material. The solid content of the oxidized starch on the base material was 1.0 g/m$^2$.

| | |
|---|---|
| Leaf bleached kraft pulp (LBKP) | 80 mass % |
| Needle bleached kraft pulp (NBKP) | 20 mass % |
| Precipitated calcium carbonate (brand name: TP-121, Okutama Kogyo Co., Ltd.) | 10 mass % |
| Aluminum sulfate | 1.0 mass % |
| Amphoteric starch (brand name: Cato3210, Nippon NSC Ltd.) | 1.0 |
| Neutral rosin size (brand name: NeuSize M-10, Harima Chemicals, Inc.) | 0.3 mass % |
| Retention aid (brand name: NR-11LS, HYMO Co., Ltd.) | 0.02 mass % |

Production Example 1

-Production of Recording Medium 1-

A coating liquid with a solid content concentration of 60 mass % was produced by mixing 70 mass % of clay used as a pigment in which clay 97 mass % of particles have a diameter of 2 μm or smaller; 30 mass % of heavy calcium carbonate with an average particle diameter of 1.1 μm; 8 mass % of styrene-butadiene copolymer emulsion, used as an adhesive, with a glass-transition temperature (Tg) of −5 degree Celsius; 1 mass % of phosphoric esterified starch; 0.5 mass % of calcium stearate used as an aid; and water.

To produce the recording medium 1, the obtained coating liquid was applied on both sides of the above base material so that 8 g/m$^2$ of solid content of the coating liquid adheres to each side using a blade coater; and the base material was dried by hot air and supercalendered.

Production Example 2

-Production of Recording Medium 2-

A coating liquid with a solid content concentration of 60 mass % was produced by mixing 70 mass % of clay used as a pigment in which clay 97 mass % of particles have a diameter of 2 μm or smaller; 30 mass % of heavy calcium carbonate with an average particle diameter of 1.1 μm; 7 mass % of styrene-butadiene copolymer emulsion, used as an adhesive, with a glass-transition temperature (Tg) of −5 degree Celsius; 0.7 mass % of phosphoric esterified starch; 0.5 mass % of calcium stearate used as an aid; and water.

To produce the recording medium 2, the obtained coating liquid was applied on both sides of the above base material so that 8 g/m$^2$ of solid content of the coating liquid adheres to each side using a blade coater; and the base material was dried by hot air and supercalendered.

First Embodiment

-Ink Set, Recording Medium, and Image Recording-

By a conventional method, an ink set 1 made up of the cyan ink produced in the production example 1, the magenta ink produced in the production example 2, the yellow ink produced in the production example 3, and the black ink produced in the production example 4 was prepared.

Images were printed on the recording medium 1 with the ink set 1 (largest ink drop size: 18 pl) at an image resolution of 600 dpi using a 300 dpi drop on demand printer prototype apparatus having nozzles with a nozzle resolution of 384 according to an embodiment of the present invention. The total amount of ink per unit area for a secondary color was limited to 140% and solid-color images and characters were formed.

Second Embodiment

-Ink Set, Recording Medium, and Image Recording-

Images were formed in substantially the same manner as the first embodiment, except that the recording medium 2 was used as a recording medium.

Third Embodiment

-Ink Set, Recording Medium, and Image Recording-

Images were formed in substantially the same manner as the first embodiment, except that a commercially available coated paper for gravure printing (brand name: Space DX, grammage=56 g/m$^2$, Nippon Paper Industries Co., Ltd.) (hereafter called a recording medium 3) was used as a recording medium.

For each of the recording medium 1, the recording medium 2, the recording medium 3, the amount of transferred pure water and the amount of transferred cyan ink produced in the production example 1 were measured as described below using a dynamic scanning absorptometer. The results are shown in table 2.

<Measurement of Amounts of Transferred Pure Water and Cyan Ink with Dynamic Scanning Absorptometer>

For each of the above recording media, the amounts of transferred pure water and cyan ink were measured using a dynamic scanning absorptometer (K350 series, type D, Kyowa Co., Ltd.) at 25 degree Celsius 50% RH. The amounts of transferred pure water and cyan ink at a contact time of 100 ms and 400 ms were obtained by interpolation, using the transferred amounts measured at time points around each contact time.

TABLE 2

| | | Pure water | | ink production example 1 (r = 25) | |
|---|---|---|---|---|---|
| | | Contact time: 100 ms | Contact time: 400 ms | Contact time: 100 ms | Contact time: 400 ms |
| First embodiment | Recording Medium 1 | 10.1 ml/m$^2$ | 20.2 ml/m$^2$ | 7.2 ml/m$^2$ | 14.8 ml/m$^2$ |
| Second embodiment | Recording Medium 2 | 25.2 ml/m$^2$ | 28.5 ml/m$^2$ | 14.6 ml/m$^2$ | 19.4 ml/m$^2$ |
| Third embodiment | Recording Medium 3 | 10.4 ml/m$^2$ | 21.8 ml/m$^2$ | 6.4 ml/m$^2$ | 8.8 ml/m$^2$ |

Qualities of the images printed in the first through third embodiments were evaluated in terms of beading, bleeding, spur marks, and glossiness. The results are shown in table 3.

<Beading>

The degree of beading in the printed green solid-color image was evaluated by eye observation according to the evaluation criteria below.

[Evaluation Criteria]

AA: No beading is observed and image is evenly printed.

BB: Beading is slightly observed.

CC: Beading is clearly observed.

DD: Excessive beading is observed.

<Bleeding>

The degree of bleeding of the printed black characters in the yellow background was evaluated by eye observation according to the evaluation criteria below.

[Evaluation Criteria]

AA: No bleeding is observed and characters are clearly printed.

BB: Bleeding is slightly observed.

CC: Bleeding is clearly observed.

DD: Excessive bleeding is observed and outlines of characters are blurred.

<Spur Marks>

The degree of spur marks in the printed images was evaluated by eye observation according to the evaluation criteria below.

[Evaluation Criteria]

AA: No spur mark is observed.

BB: Spur marks are observed slightly.

CC: Spur marks are clearly observed.

DD: Excessive spur marks are observed.

<Glossiness>

The degree of glossiness of the printed images was evaluated by eye observation according to the evaluation criteria below.

[Evaluation Criteria]

AA: Images are highly glossy.

BB: Images are glossy.

CC: Images are not glossy.

TABLE 3

| | Beading | Bleeding | Spur mark | Glossiness |
|---|---|---|---|---|
| First embodiment | BB | BB | BB | BB |
| Second embodiment | AA | AA | AA | BB |
| Third embodiment | BB | BB | BB | AA |

The present invention is not limited to the specifically disclosed embodiment, and variations and modifications may be made without departing from the scope of the present invention.

The present application is based on Japanese priority application No. 2005-327318 filed on Nov. 11, 2005, and No. 2006-025042 filed on Feb. 1, 2006, the entire contents of which are hereby incorporated by reference.

The invention claimed is:

1. A liquid drop ejecting head comprising a nozzle ejecting liquid drop of recording liquid, a liquid chamber communicatively connecting to the nozzle and a drive element pressurizing the recording liquid in the liquid chamber; a water-repellent process repelling the recording liquid is provided on a surface of a nozzle formation member forming the nozzle, and the water-repellent process of an outer circumferential part of the nozzle formation member is different from the water-repellent process on a surface of a nozzle forming part of the nozzle formation member, wherein a water-repellency on the outer circumferential part of the nozzle formation member is relatively higher than a water-repellency of the surface of the nozzle forming part.

2. The liquid drop ejecting head as claimed in claim 1, wherein an edge region of the outer circumferential part of the nozzle formation member is covered with a protection member formed with a resin member having the water-repellency.

3. The liquid drop ejecting head as claimed in claim 1, wherein the water-repellent process including silicone resin is provided on the nozzle forming part of the nozzle formation member.

4. The liquid drop ejecting head as claimed in claim 1, wherein the water-repellent process including fluorine amorphous substance compound is provided on the outer circumferential part of the nozzle formation member.

5. The liquid drop ejecting head as claimed in claim 1, wherein the head is a side shooter mechanism which is difference between an ejection direction of the liquid drop and a direction of a flow channel of the recording liquid.

6. An image forming apparatus provided with a recording head ejecting liquid drop of recording liquid, in which the recording head is the liquid drop ejection head as claimed in claim 1.

7. The image forming apparatus as claimed in claim 6, wherein the recording liquid is a ink including pigments.

8. An recording method, in which liquid drop of recording liquid is ejecting from the liquid drop ejection head as claimed in claim 1 and a recording is performed on a recording medium.

9. The recording method as claimed in claim 8, wherein the recording medium is composed of a base material and at least one coating layer on a surface of the base material.

10. The recording method as claimed in claim 8, wherein the amount of the recording liquid transferred onto the recording medium at a contact time of 100 ms measured by a dynamic scanning absorptometer with an environmental condition of 23 degree Celsius and 50% RH is between 2 and 40 ml/m$^2$, and the amount of the recording liquid transferred onto the recording medium at a contact time of 400 ms measured by a dynamic scanning absorptometer with an environmental condition of 23 degree Celsius and 50% RH is between 3 and 50 ml/m$^2$.

11. The recording method as claimed in claim 8, wherein the amount of a pure water transferred onto the recording medium at a contact time of 100 ms measured by a dynamic scanning absorptometer with an environmental condition of 23 degree Celsius and 50% RH was between 2 and 45 ml/m$^2$, and the amount of the pure water transferred onto the recording medium at a contact time of 400 ms measured by a dynamic scanning absorptometer with an enviromental condition of 23 degree Celsius and 50% RH is between 3 and 50 ml/m$^2$.

12. The recording method as claimed in claim 8, wherein the recording medium is composed of at least the base material and the coating layer, and a solid content of the coating layer is between 0.5 and 20 g/m$^2$.

13. The recording method as claimed in claim 8, wherein the recording medium is supercalendered.

14. The recording method as claimed in claim 8, wherein the recording medium contains a water-based resin.

15. The recording method as claimed in claim 8, wherein the recording liquid contains at least water, a colorant, and a humectant.

16. The recording method as claimed in claim 8, wherein a surface tension of the recording liquid at a temperature of 25 degree Celsius is between 15 and 40 mN/m.

17. The recording method as claimed in claim 8, wherein the recording liquid contains a fluorinated surfactant.

18. A liquid drop ejecting head comprising a nozzle ejecting liquid drop of recording liquid, a liquid chamber communicatively connecting to the nozzle and a drive element pressurizing the recording liquid in the liquid chamber; a water-repellent process repelling the recording liquid is provided on a surface of a nozzle formation member forming the nozzle, and the water-repellent process of an outer circumferential part of the nozzle formation member is different from the water-repellent process on a surface of a nozzle forming part of the nozzle formation member, wherein the outer circumferential part of the nozzle formation member is covered with a nozzle cover, and the water-repellent process is provided on the nozzle cover.

19. The liquid drop ejecting head as claimed in claim 18, wherein the water-repellent process is provided on both side of an outer side and an inner side of the nozzle cover.

20. A liquid drop ejecting head comprising a nozzle ejecting liquid drop of recording liquid, a liquid chamber communicatively connecting to the nozzle and a drive element pressurizing the recording liquid in the liquid chamber, wherein a water-repellency on an outer circumferential part of a nozzle formation member is relatively higher than a water-repellency of a surface of a nozzle forming part of the nozzle formation member.

21. A liquid drop ejecting head comprising a nozzle ejecting liquid drop of recording liquid, a liquid chamber communicatively connecting to the nozzle and a drive element pressurizing the recording liquid in the liquid chamber, wherein an outer circumferential part of a nozzle formation member is covered with a nozzle cover, and a water-repellency of a region of the nozzle formation member, which region does not include the outer circumferential part of the nozzle formation member that is covered with the nozzle cover, is relatively higher than a water-repellency of a surface of the nozzle cover.

* * * * *